US011353026B2

(12) United States Patent
Choi et al.

(10) Patent No.: US 11,353,026 B2
(45) Date of Patent: Jun. 7, 2022

(54) COMPRESSOR HAVING DECOMPRESSING STRUCTURE

(71) Applicant: LG Electronics Inc., Seoul (KR)

(72) Inventors: Jungsun Choi, Seoul (KR); Sangbaek Park, Seoul (KR); Cheolhwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 155 days.

(21) Appl. No.: 16/790,247

(22) Filed: Feb. 13, 2020

(65) Prior Publication Data

US 2020/0263691 A1 Aug. 20, 2020

(30) Foreign Application Priority Data

Feb. 14, 2019 (KR) ..... 10-2019-0017195

(51) Int. Cl.

| | |
|---|---|
| ***F04C 29/02*** | (2006.01) |
| ***F04C 18/02*** | (2006.01) |
| ***F04C 29/06*** | (2006.01) |
| ***F04C 28/26*** | (2006.01) |
| ***F04C 28/28*** | (2006.01) |

(52) U.S. Cl.

CPC ..... *F04C 29/021* (2013.01); *F04C 18/0215* (2013.01); *F04C 29/028* (2013.01); *F04C 29/065* (2013.01); *F04C 2210/26* (2013.01); *F04C 2240/20* (2013.01); *F04C 2240/30* (2013.01)

(58) Field of Classification Search

CPC .. F04C 29/021; F04C 18/0215; F04C 29/028; F04C 29/065; F04C 18/0253; F04C 28/26; F04C 28/28; F04C 14/26

See application file for complete search history.

(56) References Cited

U.S. PATENT DOCUMENTS

| | | | | |
|---|---|---|---|---|
| 4,596,520 | A * | 6/1986 | Arata | F04C 27/005 418/55.5 |
| 5,263,822 | A * | 11/1993 | Fujio | F04C 29/025 418/55.4 |
| 2005/0053508 | A1* | 3/2005 | Morozumi | F04C 23/008 418/55.6 |
| 2016/0195090 | A1 | 7/2016 | Toyama | |
| 2018/0073505 | A1 | 3/2018 | Choi et al. | |
| 2018/0328364 | A1* | 11/2018 | Kim | F04C 29/12 |

FOREIGN PATENT DOCUMENTS

| | | |
|---|---|---|
| EP | 3418575 | 12/2018 |
| KR | 1020180136282 | 12/2018 |
| KR | 1020180138479 | 12/2018 |

OTHER PUBLICATIONS

Extended European Search Report in European Application No. 20157345.8, dated Jul. 17, 2020, 8 pages.

* cited by examiner

*Primary Examiner* — Deming Wan
(74) *Attorney, Agent, or Firm* — Fish & Richardson P.C.

(57) ABSTRACT

Disclosed is a compressor including a compressing assembly having a decompressing structure to control an amount of oil. The decompressing structure is oriented in parallel with a length direction of the rotation shaft or in a direction toward a discharger from which the refrigerant is discharged.

21 Claims, 10 Drawing Sheets

COMPRESSOR HAVING DECOMPRESSING STRUCTURE

CROSS-REFERENCE TO RELATED APPLICATION

This application claims the benefit of Korean Patent Application No. 10-2019-0017195, filed on Feb. 14, 2019, which is hereby incorporated by reference as when fully set forth herein.

BACKGROUND

Field

The present disclosure relates to a compressor. More specifically, the present disclosure relates to a scroll type compressor that may prevent deformation of a decompressing structure that controls a supply amount of compressor oil.

Discussion of the Related Art

Generally, a compressor is an apparatus applied to a refrigeration cycle such as a refrigerator or an air conditioner, which compresses refrigerant to provide work necessary to generate heat exchange in the refrigeration cycle.

The compressors may be classified into a reciprocating type compressor, a rotary type compressor, and a scroll type compressor based on a scheme for compressing the refrigerant. Among these, the scroll type compressor performs an orbiting motion by engaging an orbiting scroll with a fixed scroll fixed in an internal space of a sealed container to define a compression chamber between a fixed wrap of the fixed scroll and an orbiting wrap of the orbiting scroll.

Compared with other types of the compressor, the scroll type compressor may obtain a relatively high compression ratio because the refrigerant is continuously compressed through the scrolls engaged with each other, and may obtain a stable torque because suction, compression, and discharge of the refrigerant proceed smoothly. For this reason, the scroll type compressor is widely used for compressing the refrigerant in the air conditioner and the like.

Referring to Japanese Patent No. 6344452, a conventional scroll type compressor includes a casing forming an outer shape of the compressor and having a discharger for discharging refrigerant, a compression assembly fixed to the casing to compress the refrigerant, and a driver fixed to the casing to drive the compression assembly, and the compression assembly and the driver are coupled to a rotation shaft that is coupled to the driver and rotates.

The compression assembly includes a fixed scroll fixed to the casing and having a fixed wrap, and an orbiting scroll including an orbiting wrap operated in a state of being engaged with the fixed wrap by the rotation shaft. Such the conventional scroll type compressor includes the rotation shaft eccentric, and the orbiting scroll fixed to the eccentric rotation shaft and rotating. Thus, the orbiting scroll orbits along the fixed scroll to compress the refrigerant.

In the conventional scroll type compressor, the compression assembly is generally disposed below the discharger, and the driver is generally disposed below the compression assembly. Further, the rotation shaft generally has one end coupled to the compression assembly and the other end passing through the driver.

The conventional scroll type compressor has difficulty in supplying oil into the compression assembly because the compression assembly is disposed above the driver and is close to the discharger. Further, the conventional scroll type compressor has a disadvantage of additionally requiring a lower frame to separately support the rotation shaft connected to the compression assembly below the driver. In addition, the conventional scroll type compressor has a problem in that, because point of applications of a gas force generated by the refrigerant inside the compressor and of a reaction force supporting the gas force do not match, the scroll tilts and reduces an efficiency and a reliability thereof.

In order to solve such problems, referring to Korean Patent Application Publication No. 10-2018-0124636, in recent years, a scroll type compressor (also known as a lower scroll type compressor) having the driver below the discharger and having the compression assembly below the driver has emerged.

FIGS. 1A and 1B illustrate a structure of a conventional lower scroll type compressor.

Referring to FIGS. 1A and 1B, a conventional lower scroll type compressor 10 is generally installed on a circuit of a refrigerant cycle having a condenser 2, an expansion valve 3, and an evaporator 4.

In the lower scroll type compressor, a driver 200 is closer to a discharger 121 than to a compressing assembly 300. The compressing assembly 300 is farthest away from the discharger 121. In this lower scroll type compressor, a rotation shaft 230 has one end connected to the driver 200, and the other end supported by the compressing assembly 300 so that a separate lower frame for supporting a rotation shaft may be omitted. The compressor has an advantage that oil P stored on one side of a casing may be supplied directly to the compressing assembly 300 without passing through the driver 200. Further, in the lower scroll type compressor, when the rotation shaft 230 is connected to the compressing assembly 300 therethrough, action points of a gas force and a reaction force coincide on the rotation shaft 230 to block vibration of the scroll of the compressing assembly 300 and to counteract a titling moment to ensure efficiency and reliability.

Referring to a right drawing, the compressing assembly 300 includes a main frame 310 passing through and supporting the rotation shaft 230, a fixed scroll 320 mounted on the main frame 230 to form a compressing chamber, and an orbiting scroll 330 disposed in the compressing chamber to compress refrigerant.

When refrigerant flows from an inflow hole 325 located in a lateral face of the fixed scroll 320, an orbiting wrap 333 placed on the orbiting scroll orbits around a fixed wrap 323 placed on the fixed scroll to compress the refrigerant. The compressed refrigerant is discharged into a discharge hole 326 disposed near the rotation shaft 230.

In this connection, a region adjacent to the rotation shaft 230 becomes a high pressure region S1 due to the compressed refrigerant, the refrigerant in the high pressure region S1 generates a force that pushes the orbiting scroll 330 towards the driver 200. Thus, the scroll type compressor may include a backpressure seal 350 on top of the orbiting scroll 330 to generate a backpressure force that cancels the pushing force through the oil supplied through the rotation shaft 230 and the refrigerant in contact with the main frame.

The rotation shaft 230 raises up the stored oil P through a plurality of oil-feeding holes 234*a*, 234*b*, and 234*c* and a plurality of oil-feeding grooves 2341*a*, 2341*b*, and 2341*c* to feed the oil to a main bearing 232*a*, an eccentric portion 232*b*, and a fixed bearing 232*c*.

In one example, on an outer surface of the backpressure seal 350, a middle pressure region V1 with a lower pressure than that of the high pressure region may be formed. A low pressure region S2 may be formed on an Oldham's ring 330 provided to orbit the orbiting scroll. Using a pressure difference between the high pressure region S1 and the middle pressure region V1 or the low pressure region S2, the oil supplied from the rotation shaft 230 is transferred through an oil transfer channel 339 and a fixed channel 329 to the fixed wrap and the orbiting wrap or the Oldham's ring 340 (pressure difference based oil feeding scheme).

The oil transfer channel 339 is provided to extend in a radial direction of the orbiting scroll 330 to deliver oil supplied through the rotation shaft 230 to an outer surface of the fixed wrap 323 of the fixed scroll. The fixed channel 329 is defined in the fixed scroll to communicate with the oil transfer channel 339 to supply the oil supplied to the oil transfer channel 339 to the middle pressure region V1.

However, since the pressure difference between the middle pressure region V1 in the high pressure region S1 is large, oil may be excessively supplied from the rotation shaft 230. Therefore, a sufficient amount of refrigerant may not be compressed, or the compressing assembly 300 may be excessively cooled, or the lubrication may not occur due to a large amount of outflow of the oil.

To prevent this problem, the scroll type compressor 300 may include a decompressing structure 360 inserted into the oil transfer channel 330 to adjust the amount of oil as supplied. The decompressing structure 360 reduces a cross-sectional area of the oil transfer channel 330 to create flow resistance, thus preventing excessive oil from being supplied.

FIGS. 2A and 2B show an assembly process of a conventional scroll type compressor equipped with the decompressing structure 360.

Referring to FIG. 2A, in the conventional scroll type compressor, the driver 200 and the compressing assembly 300 is inserted into and coupled to the casing 100. A lateral face of the driver 200 and a lateral face of the compressing assembly 300 may be coupled to an inner circumferential surface of the casing 100 via welding or the like. The compressing assembly 300 may be coupled to the casing 100 while the decompressing structure 360 has been previously inserted into the oil transfer channel 330.

Referring to FIG. 2B, the main frame 310 or the fixed scroll 320 may be transformed while the main frame 310 or the fixed scroll 330 is joined to the casing 100. When the main frame 310 or the fixed scroll 330 is deformed, significant pressure may be applied to the orbiting scroll 330. The oil transfer channel 339 extends from the rotation shaft 230 toward an outer circumferential face of the main frame 310 so that the oil transfer channel 339 itself may tilt. An inlet itself of the oil transfer channel into which the decompressing structure 360 is inserted may be deformed.

Accordingly, while the decompressing structure 360 may be disposed in an inclined manner in the oil transfer channel 339, the decompressing structure 360 may be attached to an inner wall of the oil transfer channel 339 to excessively reduce a flow area. Further, the decompressing structure 360 may be pressure-fitted into the oil transfer channel, thereby making it difficult to separate the decompressing structure 360 for repair or replacement.

When, unlike the configuration as shown, the oil transfer channel 339 is provided in the main frame, a degree of deformation thereof may be greater. Thus, it may be more difficult to achieve an installation effect of the decompressing structure.

Further, the decompressing structure is placed in parallel with a radial direction of the rotation shaft. Thus, the decompressing structure could contact a bottom of the oil transfer channel by gravity such that a cross section of the oil transfer channel may not be formed uniformly. Therefore, an error occurs in a design effect and an actual reflection effect of the decompressing structure, thereby reducing performance of the compressor.

As a result, serious problems may arise in the efficiency and reliability of the compressor 10.

SUMMARY

A purpose of the present disclosure is basically to solve the problem of the conventional compressor as mentioned above.

A purpose of the present disclosure is to provide a compressor in which a flow channel supplying lubricating oil is prevented from contacting a casing during manufacture of the compressor.

A purpose of the present disclosure is to provide a compressor in which the flow channel is prevented from deforming as the casing and internal components of compressor are installed.

A purpose of the present disclosure is to provide a compressor in which a shape of the flow channel is maintained even when the components of the compressor are assembled with each other via welding or the like, such that the decompressing structure may be installed onto or detached from the flow channel.

A purpose of the present disclosure is to provide a compressor in which one end of the flow channel is prevented from being exposed to an outer circumferential face of the compressor.

A purpose of the present disclosure is to provide a compressor in which the decompressing structure is placed at a portion of the flow channel parallel to a rotation shaft such that the decompressing structure is prevented from contacting an inner wall of the flow channel.

A purpose of the present disclosure is to provide a compressor in which the decompressing structure is prevented from being eccentrical relative to the flow channel.

A purpose of the present disclosure is to provide a compressor in which the decompressing structure may remain in a fixed state inside the flow channel.

Purposes of the present disclosure are not limited to the above-mentioned purpose. Other purposes and advantages of the present disclosure as not mentioned above may be understood from following descriptions and more clearly understood from embodiments of the present disclosure. Further, it will be readily appreciated that the purposes and advantages of the present disclosure may be realized by features and combinations thereof as disclosed in the claims.

In one embodiment of the present disclosure, a decompressing structure may be received in an oil transfer feed channel and may be oriented toward a discharger or in a direction parallel to a length direction of a rotation shaft which supplies power to a compressing assembly compressing refrigerant.

In one embodiment of the present disclosure, a casing facing in parallel with the rotation shaft does not come into contact with the compressing assembly or the driver. Therefore, the oil transfer channel is unlikely to be deformed. When the decompressing structure is installed in the oil transfer channel, the decompressing structure may be prevented from being deformed or an installation position thereof may be prevented from being changed.

In one embodiment of the present disclosure, the oil transfer channel may be defined in the fixed frame to have a larger diameter than a diameter of an oil feed channel defined in a main frame or an orbiting scroll. In this connection, the decompressing structure may include a decompressing pin. The pin may be mounted on the fixed frame fixed to the casing to prevent rotation or movement thereof.

In one embodiment of the present disclosure, the oil transfer channel in which the decompressing structure is received may be defined in a two steps manner and may be oriented in parallel with the rotation shaft. Thus, a diameter of a space in which the decompressing pin is received may be different from a diameter of a hole through which the decompressing pin passes. The hole may be shielded with a blocking bolt. The decompressing pin may be integrally formed with the blocking bolt.

In one embodiment of the present disclosure, the blocking bolt may be integrally formed with a muffler coupled to the fixed frame.

In one embodiment of the present disclosure, the decompressing pin may be inserted into the oil transfer channel when the muffler is coupled to the fixed frame while the muffler is coupled to the fixed frame.

In one embodiment of the present disclosure, the compressor may include the main frame mounted on the fixed scroll to accommodate the orbiting scroll therein, wherein the rotation shaft passes through the main frame. The compressor may include the oil transfer channel defined in at least one of the orbiting scroll or the main scroll, wherein oil supplied from the oil-feeding hole flows to the oil transfer channel. The compressor may include a fixed channel defined in the fixed scroll to communicate with the oil transfer channel and to supply the oil into a space between the orbiting scroll and the fixed scroll. The compressor may include the decompressing structure received in the oil transfer channel or the fixed channel to regulate an supply amount of the oil. The decompressing structure may be oriented toward the discharger. Further, the decompressing structure may be inserted into the oil transfer channel or the fixed channel and may be orientated in a parallel manner with a length direction of the rotation shaft.

Thus, the decompressing structure may be completely prevented from contacting the inner wall or the inner circumferential face of the casing.

In one embodiment of the present disclosure, the fixed scroll includes: a fixed end plate to which the rotation shaft is coupled; a fixed side plate extending along an outer circumferential face of the fixed end plate, wherein the main frame rests on the fixed side plate; and a fixed wrap protruding from the fixed end plate and configured to be engaged with the orbiting scroll, wherein the fixed channel includes: an inflow channel defined in the fixed side plate to communicate with the oil transfer channel, wherein oil supplied from the oil transfer channel flows into the inflow channel; and a fixed wrap communication channel defined in the fixed end plate to communicate with the inflow channel and to deliver oil supplied to the inflow channel to the fixed wrap, wherein the decompressing structure is received in the inflow channel. This prevents the decompressing structure from being oriented in a parallel manner with the ground and prevents the decompressing structure from contacting the fixed channel by an own weight thereof.

In one embodiment of the present disclosure, the inflow channel has an extension having an enlarged diameter so that the decompressing structure is received in the extension.

In one embodiment of the present disclosure, the fixed scroll further includes a receiving hole passing through one face thereof to communicate with the fixed channel, wherein the decompressing structure is inserted into the receiving hole.

In one embodiment of the present disclosure, the decompressing structure includes: a decompressing pin inserted into the fixed channel; and a decompressing head disposed on one end of the decompressing pin and having a larger diameter than a diameter of the decompressing pin.

In one embodiment of the present disclosure, the fixed scroll further includes a stopper protruding from an inner circumferential face of the fixed channel to support the decompressing head, wherein the stopper is spaced apart from the receiving hole by a length corresponding to a thickness of the decompressing head.

In one embodiment of the present disclosure, the fixed scroll further include a stopper having a smaller diameter than a diameter of the receiving hole, wherein the decompressing head includes: a main head coupled to an inner circumferential face of the receiving hole and supported on the stopper; and an auxiliary head extending from the main head to shield an inner circumferential face of the stopper.

In one embodiment of the present disclosure, the decompressing structure includes: a decompressing pin inserted into the fixed channel; and a decompressing cover coupled to the receiving hole to prevent the decompressing pin from being removed from the fixed channel.

In one embodiment of the present disclosure, the fixed scroll further include a stopper having a diameter smaller than a dimeter of the receiving hole, wherein the decompressing cover includes a main cover coupled to an inner circumferential face of the receiving hole and supported by the stopper.

In one embodiment of the present disclosure, the decompressing cover further include an auxiliary cover extending from the main cover to shield an inner circumferential face of the stopper.

In one embodiment of the present disclosure, the compressor further includes a muffler coupled to the fixed scroll to guide refrigerant discharged from the fixed scroll to the discharger, wherein the muffler includes: a receiving body having a refrigerant flow space defined therein; and a coupling body extending from an outer circumferential face of the receiving body and coupled to the fixed scroll, wherein the coupling body is in close contact with the decompressing head and is coupled to the fixed scroll.

In one embodiment of the present disclosure, the compressor further includes a muffler coupled to the fixed scroll to guide refrigerant discharged from the fixed scroll to the discharger, wherein the muffler includes: a receiving body having a refrigerant flow space defined therein; a coupling body extending from an outer circumferential face of the receiving body and coupled to the fixed scroll; and a coupling hole passing through the coupling body, wherein the decompressing head is coupled to the coupling hole.

In one embodiment of the present disclosure, the compressor further includes a muffler coupled to the fixed scroll to guide refrigerant discharged from the fixed scroll to the discharger, wherein the muffler includes: a receiving body having a refrigerant flow space defined therein; a coupling body extending from an outer circumferential face of the receiving body and coupled to the fixed scroll; and a seat groove defined in the coupling body, wherein the decompressing cover is seated in the seat groove.

In one embodiment of the present disclosure, the seat groove is constructed to receive at least a portion of the decompressing cover.

In one embodiment of the present disclosure, the compressor further includes a muffler coupled to the fixed scroll to guide refrigerant discharged from the fixed scroll to the discharger, wherein the muffler includes: a receiving body having a refrigerant flow space defined therein; a coupling body extending from an outer circumferential face of the receiving body and coupled to the fixed scroll; and a support ring protruding from and around the coupling body to support the decompressing structure, wherein the fixed scroll further includes a support groove defined therein and therearound to receive the support ring therein, wherein a position of the receiving hole coincides with a position of the support groove.

In one embodiment of the present disclosure, the decompressing cover or the decompressing head may be embodied as a bolt. The receiving hole may have a thread defined in an inner face thereof engaged with a thread of the bolt.

In one embodiment of the present disclosure, the decompressing head or the decompressing cover may be formed in a multiple-steps manner. In this connection, it is preferable that diameters of the steps decrease as the steps go toward a distal end of the decompressing pin.

In one embodiment of the present disclosure, the muffler may include a coupling hole or groove that may be engaged with the decompressing head or the decompressing cover. The coupling hole or groove may include a thread corresponding to a thread of an outer circumferential face of the decompressing head or the decompressing cover.

In one embodiment of the present disclosure, the muffler may be configured to support the decompressing structure on an inner circumferential face or an exposed surface of the muffler. As a result, the decompressing structure may be prevented from being separated from the fixed frame due to the vibration or self-weight.

The features of the above-described implantations may be combined with other embodiments as long as they are not contradictory or exclusive to each other.

Effects of the present disclosure are as follows but are limited thereto:

The present disclosure may have an effect of providing a compressor in which a flow channel supplying lubricating oil is prevented from contacting a casing during manufacture of the compressor.

The present disclosure may have an effect of providing a compressor in which the flow channel is prevented from deforming as the casing and internal components of compressor are installed.

The present disclosure may have an effect of providing a compressor in which a shape of the flow channel is maintained even when the components of the compressor are assembled with each other via welding or the like, such that the decompressing structure may be installed onto or detached from the flow channel.

The present disclosure may have an effect of providing a compressor in which one end of the flow channel is prevented from being exposed to an outer circumferential face of the compressor.

The present disclosure may have an effect of providing a compressor in which the decompressing structure is placed at a portion of the flow channel parallel to a rotation shaft such that the decompressing structure is prevented from contacting an inner wall of the flow channel.

The present disclosure may have an effect of providing a compressor in which the decompressing structure is prevented from being eccentrical relative to the flow channel.

The present disclosure may have an effect of providing a compressor in which the decompressing structure may remain in a fixed state inside the flow channel.

Effects of the present disclosure are not limited to the above effects. Those skilled in the art may readily derive various effects of the present disclosure from various configurations of the present disclosure.

DETAILED DESCRIPTIONS

Figure 1A:
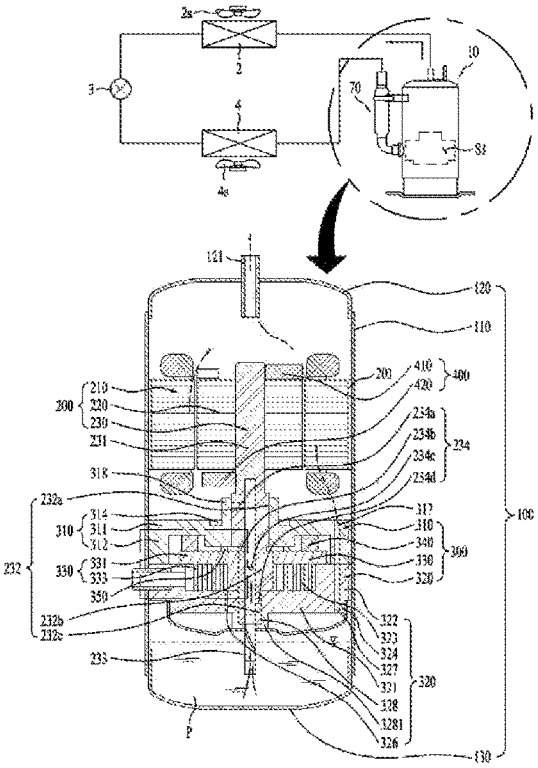
FIGS. 1A and 1B illustrate a structure of a conventional scroll type compressor.

For simplicity and clarity of illustration, elements in the figures are not necessarily drawn to scale. The same reference numbers in different figures denote the same or similar elements, and as such perform similar functionality. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

Examples of various embodiments are illustrated and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or more of the associated listed items. Expression such as "at least one of" when preceding a list of elements may modify the entire list of elements and may not modify the individual elements of the list.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

In addition, it will also be understood that when a first element or layer is referred to as being present "on" or "beneath" a second element or layer, the first element may be disposed directly on or beneath the second element or may be disposed indirectly on or beneath the second element with a third element or layer being disposed between the first and second elements or layers. It will be understood that when an element or layer is referred to as being "connected to", or "coupled to" another element or layer, it may be directly on, connected to, or coupled to the other element or layer, or one or more intervening elements or layers may be present. In addition, it will also be understood that when an element or layer is referred to as being "between" two elements or layers, it may be the only element or layer between the two elements or layers, or one or more intervening elements or layers may be present.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

A compressor according to one embodiment of the present disclosure may have a basic structure corresponding to a basic structure of the conventional lower scroll type compressor illustrated in FIG. 1A. That is, the compressor according to one embodiment of the present disclosure may differ only in terms of an oil feed structure of a compressing assembly from the conventional lower scroll type compressor illustrated in FIG. 1A. Other components of the compressor according to one embodiment of the present disclosure may be substantially identical with those of the conventional lower scroll type compressor illustrated in FIG. 1A.

Therefore, a basic structure of the compressor in accordance with the present disclosure will be described with reference to FIGS. 1A and 1B.

Figure 1B:
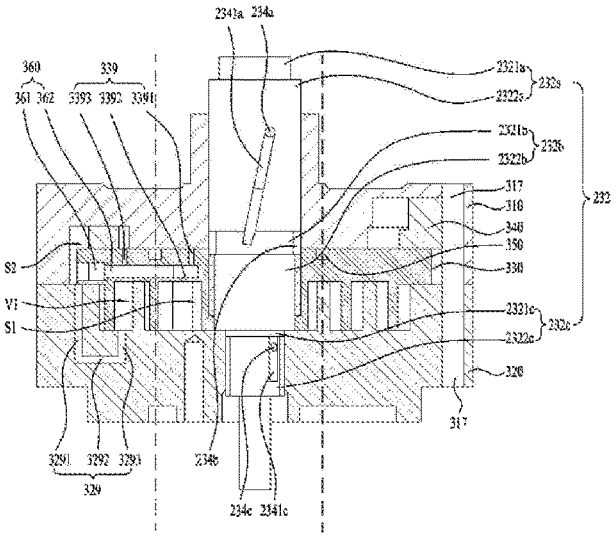
Figure 2A:
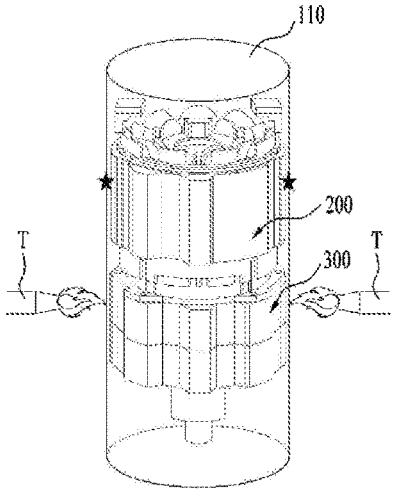
FIGS. 2A and 2B show an assembly process and an assembly result of a conventional scroll type compressor.
Figure 2B:
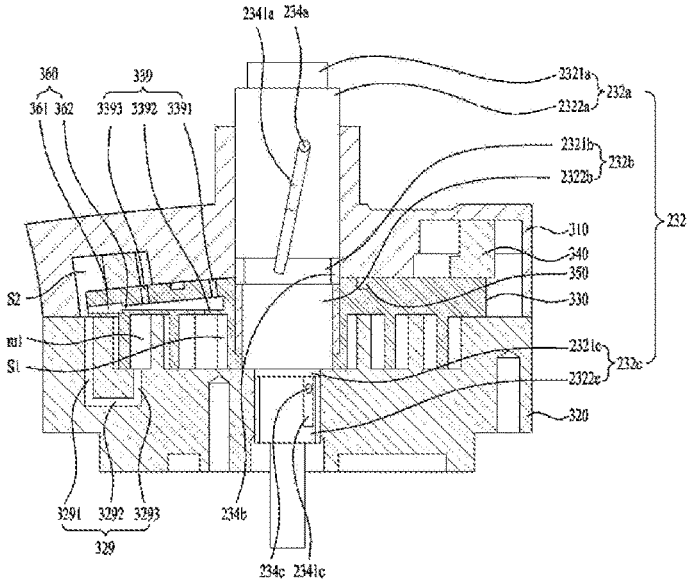

Referring to FIGS. 1A and 1B, a scroll type compressor 10 according to an embodiment of the present disclosure may include a casing 100 having therein a space in which fluid is stored or flows, a driver 200 coupled to an inner circumferential face of the casing 100 to rotate a rotation shaft 230, and a compression assembly 300 coupled to the rotation shaft 230 inside the casing and compressing the fluid.

Specifically, the casing 100 may include a discharger 121 through which refrigerant is discharged at one side. The casing 100 may include a receiving shell 110 provided in a cylindrical shape to receive the driver 200 and the compression assembly 300 therein, a discharge shell 120 coupled to one end of the receiving shell 110 and having the discharger 121, and a sealing shell 130 coupled to the other end of the receiving shell 110 to seal the receiving shell 110.

The driver 200 includes a stator 210 for generating a rotating magnetic field, and a rotor 220 disposed to rotate by the rotating magnetic field. The rotation shaft 230 may be coupled to the rotor 220 to be rotated together with the rotor 220.

The stator 210 has a plurality of slots defined in an inner circumferential face thereof along a circumferential direction and a coil is wound around the plurality of slots. Further, the stator 210 may be fixed to an inner circumferential face of the receiving shell 110. A permanent magnet may be coupled to the rotor 220, and the rotor 220 may be rotatably coupled within the stator 210 to generate rotational power. The rotation shaft 230 may be pressed into and coupled to a center of the rotor 220.

The compression assembly 300 may include a fixed scroll 320 coupled to the receiving shell 110 and disposed in a direction away from the discharger 121 with respect to the driver 200, an orbiting scroll 330 coupled to the rotation shaft 230 and engaged with the fixed scroll 320 to define a compression chamber, and a main frame 310 accommodating the orbiting scroll 330 therein and seated on the fixed scroll 320 to form an outer shape of the compression assembly 330.

As a result, the lower scroll type compressor 10 has the driver 200 disposed between the discharger 120 and the compression assembly 300. In other words, the driver 200 may be disposed at one side of the discharger 120, and the compression assembly 300 may be disposed in a direction away from the discharger 121 with respect to the driver 200. For example, when the discharger 121 is disposed on the casing 100, the compression assembly 300 may be disposed below the driver 200, and the driver 200 may be disposed between the discharger 120 and the compression assembly 300.

Thus, when oil is stored in an oil storage space p of the casing 100, the oil may be supplied directly to the compression assembly 300 without passing through the driver 200. In addition, since the rotation shaft 230 is coupled to and supported by the compression assembly 300, a lower frame for rotatably supporting the rotation shaft may be omitted.

In one example, the lower scroll type compressor 10 of the present disclosure may be provided such that the rotation shaft 230 penetrates not only the orbiting scroll 330 but also the fixed scroll 320 to be in face contact with both the orbiting scroll 330 and the fixed scroll 320.

As a result, an inflow force generated when the fluid such as the refrigerant is flowed into the compression assembly 300, a gas force generated when the refrigerant is compressed in the compression assembly 300, and a reaction force for supporting the same may be directly exerted on the rotation shaft 230. Accordingly, the inflow force, the gas force, and the reaction force may be exerted to a point of application of the rotation shaft 230. As a result, since a tilting moment does not act on the orbiting scroll 320 coupled to the rotation shaft 230, tilting or overturn of the orbiting scroll may be blocked. In other words, tilting in an axial direction of the tilting may be attenuated or prevented, and the overturn moment of the orbiting scroll 330 may also be attenuated or suppressed. As a result, noise and vibration generated in the lower scroll type compressor 10 may be blocked.

In addition, the fixed scroll 320 is in face contact with and supports the rotation shaft 230, so that durability of the rotation shaft 230 may be reinforced even when the inflow force and the gas force act on the rotation shaft 230.

In addition, a backpressure generated while the refrigerant is discharged to outside is also partially absorbed or supported by the rotation shaft 230, so that a force (normal force) in which the orbiting scroll 330 and the fixed scroll 320 become excessively close to each other in the axial direction may be reduced. As a result, a friction force between the orbiting scroll 330 and the fixed scroll 230 may be greatly reduced.

As a result, the compressor 10 attenuates the tilting in the axial direction and the overturn or tilting moment of the orbiting scroll 330 inside the compression assembly 300 and reduces the frictional force of the orbiting scroll, thereby increasing an efficiency and a reliability of the compression assembly 300.

In one example, the main frame 310 of the compression assembly 300 may include a main end plate 311 provided at one side of the driver 200 or at a lower portion of the driver 300, a main side plate 312 extending in a direction farther away from the driver 200 from an inner circumferential face of the main end plate 311 and seated on the fixed scroll 330, and a main shaft receiving portion 318 extending from the main end plate 311 to rotatably support the rotation shaft 230.

A main hole 317 for guiding the refrigerant discharged from the fixed scroll 320 to the discharger 121 may be further defined in the main end plate 311 or the main side plate 312.

The main end plate 311 may further include an oil pocket 314 that is engraved in an outer face of the main shaft receiving portion 318. The oil pocket 314 may be defined in an annular shape, and may be defined to be eccentric to the main shaft receiving portion 318. When the oil stored in the sealing shell 130 is transferred through the rotation shaft 230 or the like, the oil pocket 314 may be defined such that the oil is supplied to a portion where the fixed scroll 320 and the orbiting scroll 330 are engaged with each other.

The fixed scroll 320 may include a fixed end plate 321 coupled to the receiving shell 110 in a direction away from the driver 300 with respect to the main end plate 311 to form the other face of the compression assembly 300, a fixed side plate 322 extending from the fixed end plate 321 to the discharger 121 to be in contact with the main side plate 312, and a fixed wrap 323 disposed on an inner circumferential face of the fixed side plate 322 to define the compression chamber in which the refrigerant is compressed.

In one example, the fixed scroll 320 may include a fixed through-hole 328 defined to penetrate the rotation shaft 230, and a fixed shaft receiving portion 3281 extending from the fixed through-hole 328 such that the rotation shaft is rotatably supported. The fixed shaft receiving portion 3331 may be disposed at a center of the fixed end plate 321.

A thickness of the fixed end plate 321 may be equal to a thickness of the fixed shaft receiving portion 3381. In this case, the fixed shaft receiving portion 3281 may be inserted into the fixed through-hole 328 instead of protruding from the fixed end plate 321.

The fixed side plate 322 may include an inflow hole 325 defined therein for flowing the refrigerant into the fixed wrap 323, and the fixed end plate 321 may include discharge hole 326 defined therein through which the refrigerant is discharged. The discharge hole 326 may be defined in a center direction of the fixed wrap 323, or may be spaced apart from the fixed shaft receiving portion 3281 to avoid interference with the fixed shaft receiving portion 3281, or the discharge hole 326 may include a plurality of discharge holes.

The orbiting scroll 330 may include an orbiting end plate 331 disposed between the main frame 310 and the fixed scroll 320, and an orbiting wrap 333 disposed below the orbiting end plate to define the compression chamber together with the fixed wrap 323 in the orbiting end plate.

The orbiting scroll 330 may further include an orbiting through-hole 338 defined through the orbiting end plate 331 to rotatably couple the rotation shaft 230.

The rotation shaft 230 may be disposed such that a portion thereof coupled to the orbiting through-hole 338 is eccentric. Thus, when the rotation shaft 230 is rotated, the orbiting scroll 330 moves in a state of being engaged with the fixed wrap 323 of the fixed scroll 320 to compress the refrigerant.

Specifically, the rotation shaft 230 may include a main shaft 231 coupled to the driver 200 and rotating, and a bearing 232 connected to the main shaft 231 and rotatably coupled to the compression assembly 300. The bearing 232 may be included as a member separate from the main shaft 231, and may accommodate the main shaft 231 therein, or may be integrated with the main shaft 231.

The bearing 232 may include a main bearing **232*c* inserted into the main shaft receiving portion 318 of the main frame 310 and rotatably supported, a fixed bearing 232*a* inserted into the fixed shaft receiving portion 3281 of the fixed scroll 320 and rotatably supported, and an eccentric shaft 232*b* disposed between the main bearing 232*c* and the fixed bearing 232*a*, and inserted into the orbiting through-hole 338 of the orbiting scroll 330** and rotatably supported.

In this connection, the main bearing **232*c* and the fixed bearing 232*a* may be coaxial to have the same axis center, and the eccentric shaft 232*b* may be formed such that a center of gravity thereof is radially eccentric with respect to the main bearing 232*c* or the fixed bearing 232*a*. In addition, the eccentric shaft 232*b* may have an outer diameter greater than an outer diameter of the main bearing 232*c* or an outer diameter of the fixed bearing 232*a*. As such, the eccentric shaft 232*b* may provide a force to compress the refrigerant while orbiting the orbiting scroll 330 when the bearing 232 rotates, and the orbiting scroll 330 may be disposed to regularly orbit the fixed scroll 320 by the eccentric shaft 232*b***.

However, in order to prevent the orbiting scroll 320 from rotating, the compressor 10 of the present disclosure may further include an Oldham's ring 340 coupled to an upper portion of the orbiting scroll 320. The Oldham's ring 340 may be disposed between the orbiting scroll 330 and the main frame 310 to be in contact with both the orbiting scroll 330 and the main frame 310. The Oldham's ring 340 may be disposed to linearly move in four directions of front, rear, left, and right directions to prevent the rotation of the orbiting scroll 320.

In one example, the rotation shaft 230 may be disposed to completely pass through the fixed scroll 320 to protrude out of the compression assembly 300. As a result, the rotation shaft 230 may be in direct contact with outside of the compression assembly 300 and the oil stored in the sealing shell 130. The rotation shaft 230 may supply the oil into the compression assembly 300 while rotating.

The oil may be supplied to the compression assembly 300 through the rotation shaft 230. An oil feed channel 234 for supplying the oil to an outer circumferential face of the main bearing **232*c*, an outer circumferential face of the fixed bearing 232*a*, and an outer circumferential face of the eccentric shaft 232*b* may be formed at or inside the rotation shaft 230**.

In addition, a plurality of oil feed holes 234*a*, 234*b*, 234*c*, and 234*d* may be defined in the oil feed channel 234. Specifically, the oil feed hole may include a first oil feed hole 234*a*, a second oil feed hole 234*b*, a third oil feed hole 234*c*, and a fourth oil feed hole 234*d*. First, the first oil feed hole 234*a* may be defined to penetrate through the outer circumferential face of the main bearing 232*c*.

The first oil feed hole 234*a* may be defined to penetrate into the outer circumferential face of the main bearing 232*c* in the oil feed channel 234. In addition, the first oil feed hole 234*a* may be defined to, for example, penetrate an upper portion of the outer circumferential face of the main bearing 232*c*, but is not limited thereto. That is, the first oil feed hole 234*a* may be defined to penetrate a lower portion of the outer circumferential face of the main bearing 232*c*. For reference, unlike as shown in the drawing, the first oil feed hole 234*a* may include a plurality of holes. In addition, when the first oil feed hole 234*a* includes the plurality of holes, the plurality of holes may be defined only in the upper portion or only in the lower portion of the outer circumferential face of the main bearing 232*c*, or may be defined in both the upper and lower portions of the outer circumferential face of the main bearing 232*c*.

In addition, the rotation shaft 230 may include an oil feeder 233 disposed to pass through a muffler 500 to be described later to be in contact with the stored oil of the casing 100. The oil feeder 233 may include an extension shaft 233*a* passing through the muffler 500 and in contact with the oil, and a spiral groove 233*b* spirally defined in an outer circumferential face of the extension shaft 233*a* and in communication with the supply channel 234.

Thus, when the rotation shaft 230 is rotated, due to the spiral groove 233*b*, a viscosity of the oil, and a pressure difference between a high pressure region S1 and an intermediate pressure region V1 inside the compression assembly 300, the oil rises through the oil feeder 233 and the supply channel 234 and is discharged into the plurality of oil feed holes. The oil discharged through the plurality of oil feed holes 234*a*, 234*b*, 234*c*, and 234*d* not only maintains an airtight state by forming an oil film between the fixed scroll 250 and the orbiting scroll 240, but also absorbs frictional heat generated at friction portions between the components of the compression assembly 300 and discharge the heat.

The oil guided along the rotation shaft 230 and supplied through the first oil feed hole 234*a* may lubricate the main frame 310 and the rotation shaft 230. In addition, the oil may be discharged through the second oil feed hole 234*b* and supplied to a top face of the orbiting scroll 240, and the oil supplied to the top face of the orbiting scroll 240 may be guided to the intermediate pressure region through the pocket groove 314. For reference, the oil discharged not only through the second oil feed hole 234*b* but also through the first oil feed hole 234*a* or the third oil feed hole 234*d* may be supplied to the pocket groove 314.

In one example, the oil guided along the rotation shaft 230 may be supplied to the Oldham's ring 340 and the fixed side plate 322 of the fixed scroll 320 installed between the orbiting scroll 240 and the main frame 230. Thus, wear of the fixed side plate 322 of the fixed scroll 320 and the Oldham's ring 340 may be reduced. In addition, the oil supplied to the third oil feed hole 234*c* is supplied to the compression chamber to not only reduce wear due to friction between the orbiting scroll 330 and the fixed scroll 320, but also form the oil film and discharge the heat, thereby improving a compression efficiency.

Although a centrifugal oil feed structure in which the lower scroll type compressor 10 uses the rotation of the rotation shaft 230 to supply the oil to the bearing has been described, the centrifugal oil feed structure is merely an example. Further, a differential pressure supply structure for supplying oil using a pressure difference inside the compression assembly 300 and a forced oil feed structure for supplying oil through a toroid pump, and the like may also be applied.

In one example, the compressed refrigerant is discharged to the discharge hole 326 along a space defined by the fixed wrap 323 and the orbiting wrap 333. The discharge hole 326 may be more advantageously disposed toward the discharger 121. This is because the refrigerant discharged from the discharge hole 326 is most advantageously delivered to the discharger 121 without a large change in a flow direction.

However, because of structural characteristics that the compression assembly 300 is provided in a direction away from the discharger 121 with respect to the driver 200, and that the fixed scroll 320 should be disposed at an outermost portion of the compression assembly 300, the discharge hole 326 is disposed to spray the refrigerant in a direction opposite to the discharger 121.

In other words, the discharge hole 326 is defined to spray the refrigerant in a direction away from the discharger 121 with respect to the fixed end plate 321. Therefore, when the refrigerant is sprayed into the discharge hole 326 as it is, the refrigerant may not be smoothly discharged to the discharger 121, and when the oil is stored in the sealing shell 130, the refrigerant may collide with the oil and be cooled or mixed.

In order to prevent this problem, the compressor 10 in accordance with the present disclosure may further include the muffler 500 coupled to an outermost portion of the fixed scroll 320 and providing a space for guiding the refrigerant to the discharger 121.

The muffler 500 may be disposed to seal one face disposed in a direction farther away from the discharger 121 of the fixed scroll 320 to guide the refrigerant discharged from the fixed scroll 320 to the discharger 121.

The muffler 500 may include a coupling body 520 coupled to the fixed scroll 320 and a receiving body 510 extending from the coupling body 520 to define sealed space therein. Thus, the refrigerant sprayed from the discharge hole 326 may be discharged to the discharger 121 by switching the flow direction along the sealed space defined by the muffler 500.

Further, since the fixed scroll 320 is coupled to the receiving shell 110, the refrigerant may be restricted from flowing to the discharger 121 by being interrupted by the fixed scroll 320. Therefore, the fixed scroll 320 may further include a bypass hole 327 defined therein allowing the refrigerant penetrated the fixed end plate 321 to pass through the fixed scroll 320. The bypass hole 327 may be disposed to be in communication with the main hole 317. Thus, the refrigerant may pass through the compression assembly 300, pass the driver 200, and be discharged to the discharger 121.

The more the refrigerant flows inward from an outer circumferential face of the fixed wrap 323, the higher the pressure compressing the refrigerant. Thus, an interior of the fixed wrap 323 and an interior of the orbiting wrap 333 maintain in a high pressure state. Accordingly, a discharge pressure is exerted to a rear face of the orbiting scroll as it is, and the backpressure is exerted toward the fixed scroll in the orbiting scroll in a reactional manner. The compressor 10 of the present disclosure may further include a backpressure seal 350 that concentrates the backpressure on a portion where the orbiting scroll 320 and the rotation shaft 230 are coupled to each other, thereby preventing leakage between the orbiting wrap 333 and the fixed wrap 323.

The backpressure seal 350 is disposed in a ring shape to maintain an inner circumferential face thereof at a high pressure, and separate an outer circumferential face thereof at an intermediate pressure lower than the high pressure. Therefore, the backpressure is concentrated on the inner circumferential face of the backpressure seal 350, so that the orbiting scroll 330 is in close contact with the fixed scroll 320.

In this connection, considering that the discharge hole 326 is defined to be spaced apart from the rotation shaft 230, the backpressure seal 350 may also be disposed such that a center thereof is biased toward the discharge hole 326.

In addition, due to the backpressure seal 350, the oil supplied from the first oil feed groove 234*a* may be supplied to the inner circumferential face of the backpressure seal 350. Therefore, the oil may lubricate a contact face between the main scroll and the orbiting scroll. Further, the oil supplied to the inner circumferential face of the backpressure seal 350 may generate a backpressure for pushing the orbiting scroll 330 to the fixed scroll 320 together with a portion of the refrigerant.

As such, the compression space of the fixed wrap 323 and the orbiting wrap 333 may be divided into the high pressure region S1 inside the backpressure seal 350 and the intermediate pressure region V1 outside the backpressure seal 350 on the basis of the backpressure seal 350. In one example, the high pressure region S1 and the intermediate pressure region V1 may be naturally divided because the pressure is increased in a process in which the refrigerant is inflowed and compressed. However, since the pressure change may occur critically due to a presence of the backpressure seal 350, the compression space may be divided by the backpressure seal 350.

In one example, the oil supplied to the compression assembly 300, or the oil stored in the casing 100 may flow toward an upper portion of the casing 100 together with the refrigerant as the refrigerant is discharged to the discharger 121. In this connection, because the oil is denser than the refrigerant, the oil may not be able to flow to the discharger 121 by a centrifugal force generated by the rotor 220, and may be attached to inner walls of the discharge shell 110 and the receiving shell 120. The lower scroll type compressor 10 may further include collection channels respectively on outer circumferential faces of the driver 200 and the compression assembly 300 to collect the oil attached to an inner wall of the casing 100 to the oil storage space of the casing 100 or the sealing shell 130.

The collection channel may include a driver collection channel 201 defined in an outer circumferential face of the driver 200, a compressor collection channel 301 defined in an outer circumferential face of the compression assembly 300, and a muffler collection channel 501 defined in an outer circumferential face of the muffler 500.

The driver collection channel 201 may be defined by recessing a portion of an outer circumferential face of the stator 210 is recessed, and the compressor collection channel 301 may be defined by recessing a portion of an outer circumferential face of the fixed scroll 320. In addition, the muffler collection channel 501 may be defined by recessing a portion of the outer circumferential face of the muffler. The driver collection channel 201, the compressor collection channel 301, and the muffler collection channel 501 may be defined in communication with each other to allow the oil to pass therethrough.

As described above, because the rotation shaft 230 has a center of gravity biased to one side due to the eccentric shaft 232*b*, during the rotation, an unbalanced eccentric moment occurs, causing an overall balance to be distorted. Accordingly, the lower scroll type compressor 10 of the present disclosure may further include a balancer 400 that may offset the eccentric moment that may occur due to the eccentric shaft 232*b*.

Because the compression assembly 300 is fixed to the casing 100, the balancer 400 is preferably coupled to the rotation shaft 230 itself or the rotor 220 disposed to rotate. Therefore, the balancer 400 may include a central balancer 410 disposed on a bottom of the rotor 220 or on a face f acing the compression assembly 300 to offset or reduce an eccentric load of the eccentric shaft 232*b*, and an outer balancer 420 coupled to a top of the rotor 220 or the other face facing the discharger 121 to offset an eccentric load or an eccentric moment of at least one of the eccentric shaft 232*b* and the outer balancer 420.

Because the central balancer 410 is disposed relatively close to the eccentric shaft 232*b*, the central balancer 410 may directly offset the eccentric load of the eccentric shaft 232*b*. Accordingly, the central balancer 410 is preferably disposed eccentrically in a direction opposite to the direction in which the eccentric shaft 232*b* is eccentric. As a result, even when the rotation shaft 230 rotates at a low speed or a high speed, because a distance away from the eccentric shaft 232*b* is close, the central balancer 410 may effectively offset an eccentric force or the eccentric load generated in the eccentric shaft 232*b* almost uniformly.

The outer balancer 420 may be disposed eccentrically in a direction opposite to the direction in which the eccentric shaft 232*b* is eccentric. However, the outer balancer 420 may be eccentrically disposed in a direction corresponding to the eccentric shaft 232*b* to partially offset the eccentric load generated by the central balancer 410.

As a result, the central balancer 410 and the outer balancer 420 may offset the eccentric moment generated by the eccentric shaft 232*b* to assist the rotation shaft 230 to rotate stably.

Figure 3:
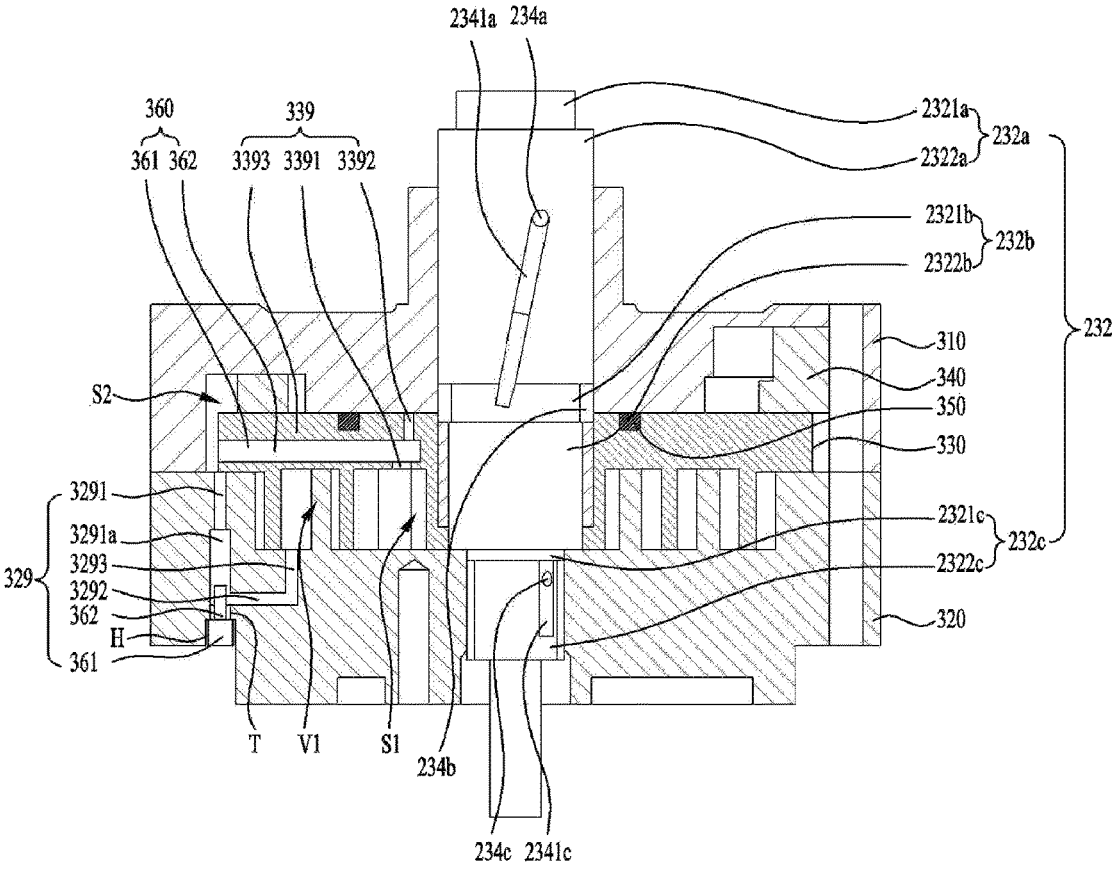
FIG. 3 illustrates a structure of a compressing assembly and a decompressing structure of a scroll type compressor in accordance with the present disclosure.

FIG. 3 illustrates in detail a structure of the compressing assembly of the present disclosure.

The compressing assembly may include oil transfer channels 319 and 339 defined in at least one of the orbiting scroll 330 or the main scroll 310. The oil supplied from the feed channel 234 may flow into the oil transfer channels 319 and 339. The compressing assembly may include a fixed channel 329 defined in the fixed scroll to communicate with the oil transfer channels to supply the oil into a space between the orbiting scroll 330 and the fixed scroll 310.

When the oil transfer channel is defined in the orbiting scroll, the oil transfer channel may include an orbiting scroll related transfer channel 339. The orbiting scroll related transfer channel 339 may include an orbiting scroll communication channel 3391 through which the oil delivered from the first oil-feeding hole 234*a* or the first oil-feeding groove 2341*a* is introduced into the orbiting scroll, and may include a connection channel 3392 extending from the orbiting scroll communication channel toward the outer circumferential face of the orbiting scroll. The orbiting scroll related transfer channel 339 may further include a branched channel 3393 branching from the connection channel 3392 towards the Oldham's ring and extending to one face of the orbiting scroll.

The orbiting scroll communication channel 3391 may be defined to penetrate the orbiting end plate 331 of the orbiting scroll. The oil discharged from the first oil-feeding groove 234*a* may be introduced to the orbiting scroll communication channel 3391. The connection channel 3392 may be defined to extend from the orbiting scroll communication channel 3391 to deliver the oil to the fixed side plate 322. Further, the connection channel 3392 may be defined to have a distal end extending to one face of the fixed side plate 322. The branched channel 3393 may be defined to penetrate the orbiting end plate 331 to supply the oil to the Oldham's ring 340 spaced from the outer circumferential face of the backpressure seal 350.

In one example, the fixed channel 329 may include an inflow channel 3291 defined inside the fixed side plate to communicate with the connection channel 3392. The oil supplied to the oil transfer channel flows to the inflow channel 3291. The fixed channel 329 may include a fixed wrap communication channel 3292 defined inside the fixed end plate to communicate with the inflow channel 3291 to deliver the oil supplied to the inflow channel to the fixed wrap 332.

In this connection, the fixed channel 329 should supply the oil to the outer circumferential face of at least the fixed wrap 323. Thus, the inflow channel 3291 may be defined to extend from the fixed side plate to have an extending length larger than or equal to a length corresponding to the thickness of the fixed wrap 323. Further, the fixed wrap communication channel 3292 may extend from the inflow channel 3291 to the inner circumferential face of an outermost portion of the fixed wrap 323. The inlet 325 into which the refrigerant flows is in communication with an outermost surface of the fixed wrap 323. This is because at the outermost face of the fixed wrap 323, the fixed wrap begins to engage with the orbiting wrap 333.

In one example, when the inflow channel 3291 extends in a longer manner than the thickness of the fixed wrap 323, the fixed channel 329 may further include a lubricating channel 3293 defined to extend from the fixed wrap communication channel 3292 to an inner side face of the fixed end plate 323 or a portion directly communicating with the fixed wrap 323. The inflow channel 3291 and the lubricating channel 3293 may be arranged in a parallel manner to each other. The fixed wrap communication channel 3292 may be defined to be perpendicular or inclined with respect to the inflow channel and the lubricating channel.

Thus, one end of the oil transfer channel 339 or the orbiting scroll communication channel 3391 may be located in the high pressure region S1 and the fixed channel 329 may be located in the middle pressure region V1. Thus, due to the pressure difference therebetween, the oil supplied from the first oil-feeding hole 234*a* may be input to the oil transfer channel 339 and be transferred to the fixed channel 329. Thus, the oil may be delivered up to the fixed wrap 323 to lubricate the orbiting wrap 333 and the fixed wrap 323.

Further, a portion of the oil supplied to the oil transfer channel 339 may be discharged into the branched channel 3393 to lubricate the Oldham's ring 340 and the main frame 310.

However, the branched channel 3393 is defined such that a portion of the oil leaks. Nevertheless, the pressure difference between the high pressure region S1 and the middle pressure region V1 may be very large when the orbiting scroll 330 is orbiting at a high speed. As a result, the oil may be excessively to the fixed wrap 323 and the orbiting wrap 333.

Therefore, a large amount of the oil may be added to the refrigerant, or the oil may cool down the fixed wrap 323 and the orbiting wrap 333, or the oil may be completely exhausted before the oil is collected. This may cause the oil supply to the fixed wrap 323 to stop.

To prevent this problem, the compressor in accordance with one embodiment of the present disclosure has a decompressing structure 360 installed in the oil transfer channel 339 or the fixed channel 329 to reduce the pressure difference. The decompressing structure 360 may be inserted into the oil transfer channel or the fixed channel to reduce the diameter of the channel to increase the channel resistance. Further, the decompressing structure 360 may maximize the friction with the oil to maximize the channel resistance. Therefore, the pressure difference between the high pressure region S1 and the middle pressure region V1 is partially reduced by the decompressing structure 360 to prevent the oil from being excessively supplied to the fixed wrap 323 and orbiting wrap 333.

In one example, the decompressing structure 360 is inserted and installed into the oil transfer channel or the fixed channel. Accordingly, the oil transfer channel or the fixed channel may further include a receiving hole H in communication with the outside of the compressing assembly 300. The decompressing structure 360 may be inserted into the receiving hole H.

In this connection, the outer circumferential face of the main end plate 311 and the outer circumferential face of the fixed side plate 322 are joined to the inner circumferential face of the casing 100. Thus, the receiving hole H is preferably constructed so as not to face one side of the casing 100. Further, the outer circumferential face of the main end plate 311 and the outer circumferential face of the fixed side plate 322 may deform via welding or pressurization when the main end plate 311 or the fixed side plate 322 is combined with the casing 100. For this reason, the receiving hole H is preferably installed in a portion other than the outer circumferential face of the main end plate 311 and the outer circumferential face of the fixed side plate 322.

Further, the decompressing structure 360 may be placed in an inner space of the oil transfer channel 339 or the fixed channel 329 and may be spaced apart from the inner circumferential of the oil transfer channel 339 or the fixed channel 329 rather than being in contact with a portion of the inner circumferential face of the oil transfer channel 339 or the fixed channel 329. This is because when vibration occurs in the compressing assembly 300, the decompressing structure 360 may collide with the inner circumferential face of the oil transfer channel 339 or the inner circumferential face of the fixed channel 329, thus causing noise or shock. Further, this is because of a following fact: when the decompressing structure 360 contacts a portion of the inner circumferential face of the oil transfer channel 339 or of the fixed channel 329, a flow rate of the oil flowing around the decompressing structure 360 may vary; the decompressing structure 360 may be fused with the oil transfer channel 339 or the fixed channel 329; thus, the durability and reliability of the compressing assembly 300 may be greatly reduced.

Thus, in the compressor in accordance with the present disclosure, the decompressing structure 360 may be disposed in the oil transfer channel or the fixed channel and may be oriented toward the discharger 121 or the driver 300 or in a parallel direction to the rotation shaft 230.

Due to the nature of the compressor 10, the direction toward the discharger 121 or the driver 300 or the direction parallel to the rotation shaft 230 is very likely perpendicular to the ground. Thus, the decompressing structure 360 may be prevented from contacting the inner circumferential face of the oil transfer channel 339 or the fixed channel 329.

Further, even when the compressor 10 is lying on the lateral face or placed obliquely, but when the decompressing structure 360 is oriented in a parallel manner to the rotation shaft, the decompressing structure 360 is oriented alongside the receiving shell 110 as a barrel of the casing 100. Thus, even when a deformation occurs on the surface of the main frame 310 or the fixed scroll 330 during the combination between the receiving shell 110 and the main frame 310 or the fixed scroll, the oil transfer channel and the fixed channel which are oriented to be parallel to the rotation shaft may not be deformed or may be very little deformed. Therefore, the position of the decompressing structure 360 may be prevented from varying.

Further, the decompressing structure 360 being oriented to be parallel to the rotation shaft means that the receiving hole H included in the oil transfer channel 339 or the fixed channel 329 is spaced apart from the receiving shell 110. Therefore, since a portion of the receiving shell 110 at which the receiving shell 110 is coupled with the compressing assembly 300 via welding or the like is completely spaced apart from the receiving hole H, the receiving hole H may be prevented from being deformed. Thus, the installation and repair/detaching of the decompressing structure 360 may be facilitated.

In one example, the inflow channel 3291 is defined in the fixed frame 320 for high durability. The oil from the inflow channel 3291 flows into the middle pressure region V1 located in the fixed frame 320. Therefore, the decompressing structure 360 may be inserted into the inflow channel 3291. As a result, the decompressing structure 360 may have stability against external shock and vibration. The amount of the oil supplied to the middle pressure region V1 may be adjusted immediately.

Thus, the fixed frame 320 may further include the receiving hole H defined to penetrate through the fixed end plate 321 to communicate with the inflow channel 3291. The decompressing structure 360 may be inserted into the receiving hole H. The receiving hole H may be defined in the opposite side of the oil transfer channel 339. Further, the inflow channel 3291 may be defined to be larger in diameter than both ends of the decompressing structure 360 to accommodate the decompressing structure 360 therein. That is, the inflow channel 3291 may further include an extension 3291*a* having a larger diameter than a diameter of an inlet communicating with the oil transfer channel or the receiving hole H to form a space in which the decompressing structure is installed. For example, the inflow channel 3291 may be defined in a two steps manner. Due to the receiving hole H having this construction, the inflow channel 3219 may extend towards the muffler 500 beyond an inlet of the fixed wrap communication channel 3292.

The decompressing structure 360 may include a decompressing pin 362 inserted into the inflow channel 3291 and a decompressing head 361 coupled to one end of the decompressing pin 362. The decompressing head 361 may be integrally formed with the decompressing pin 362. A diameter of the head may be larger than a diameter of the decompressing pin 362. A diameter of the decompressing head 361 may correspond to the diameter of the receiving hole H. The decompressing head 361 may be received in the receiving hole H to seal the receiving hole H.

For example, the decompressing head 361 may be pressure-fitted into the receiving hole H to seal the receiving hole H. The decompressing head 361 may be embodied as a bolt. In this case, in the inner circumferential face of the receiving hole H, a threaded groove may be defined to be engaged with a thread of the bolt so that the decompressing head 361 and the receiving hole H may be combined with each other in a sealing manner.

Thus, when the decompressing pin 362 is inserted into the inflow channel 3291 and the decompressing head 361 is coupled to the receiving hole H, the decompressing pin 362 may remain to be spaced, by a constant spacing, from the inner circumferential face of the inflow channel 3291 or the inner circumferential face of the extension 3291*a*.

In one example, the receiving hole H or the inflow channel 3291 may further include a stopper T that protrudes from the inner circumferential face of the inflow channel 3291 to support one side of the decompressing head 361. In this way, the stopper may prevent a situation in which the decompressing pin 362 itself may be completely inserted into the receiving hole H, and thus, an entirety of the decompressing structure 360 is accommodated in the extension 3291*a*. In this connection, the stopper T may be spaced from the receiving hole H at a depth or a length corresponding to a thickness of the decompressing head 361. Thus, when the decompressing head 361 is seated on the stopper T, the surface of the decompressing head 361 may be prevented from protruding out of the fixed frame 320. This prevents the decompressing head 361 from interfering with the refrigerant flowing inside the muffler 500.

The receiving hole H may have the same diameter as that of the extension 3291*a*. The stopper T may be disposed between the extension 3291*a* and the receiving hole H.

Figure 4:
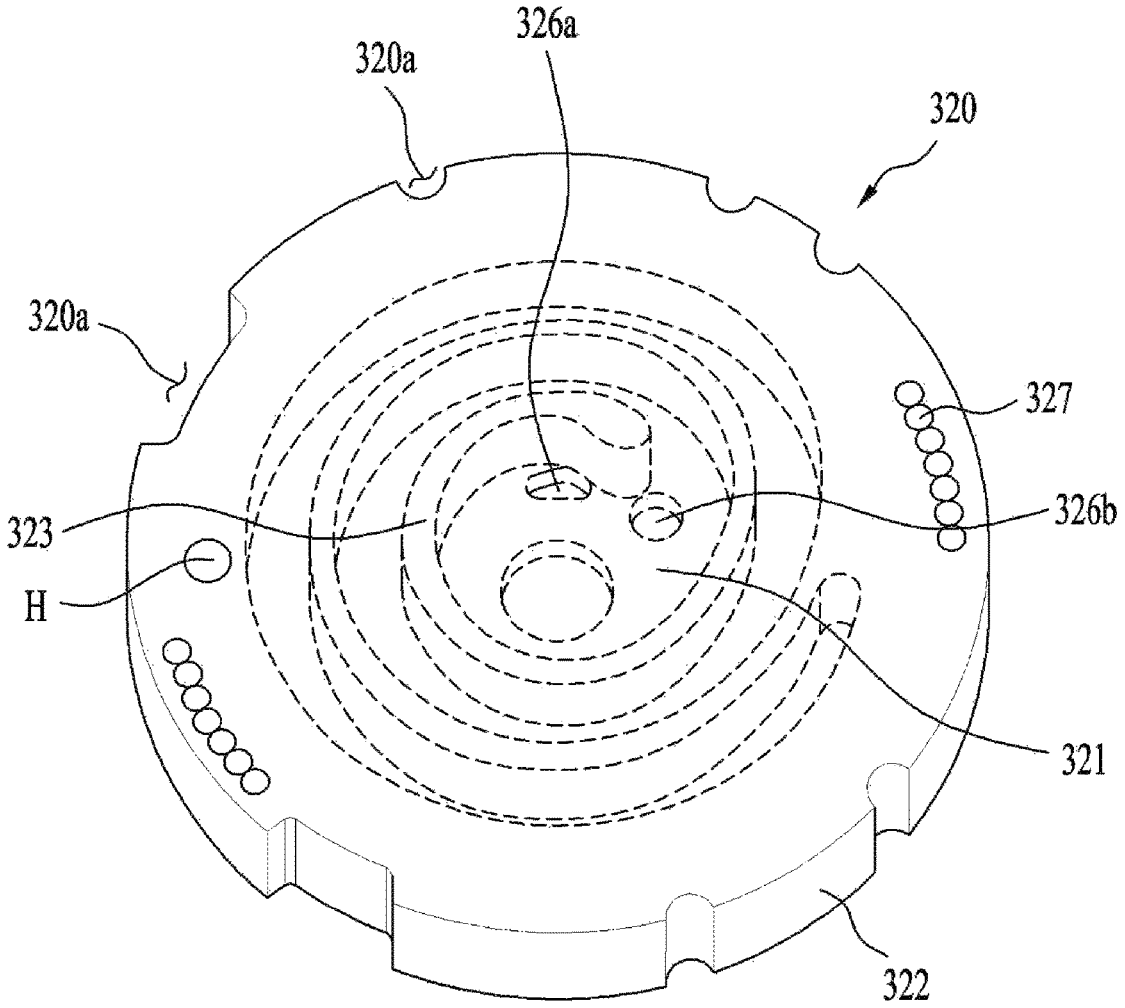
FIG. 4 illustrates a structure of the fixed scroll in accordance with the present disclosure.

FIG. 4 illustrates a structure where the receiving hole H is installed in the fixed frame 320.

The receiving hole H may be defined to penetrate the fixed end plate 321 which is disposed outside the fixed wrap 323 of the fixed frame 320. Thus, the receiving hole H and the decompressing structure 360 may be prevented from interfering with the refrigerant flowing inside the fixed wrap 323. Further, this prevents the refrigerant from leaking into the receiving hole H.

In one example, a muffler 500 may be coupled to the fixed end plate 322 and may seal the receiving hole H. In this connection, the muffler 500 may pressurize the decompressing structure 360. This may prevent the decompressing structure 360 from escaping or being removed from the receiving hole H due to the internal pressure.

Figure 5:
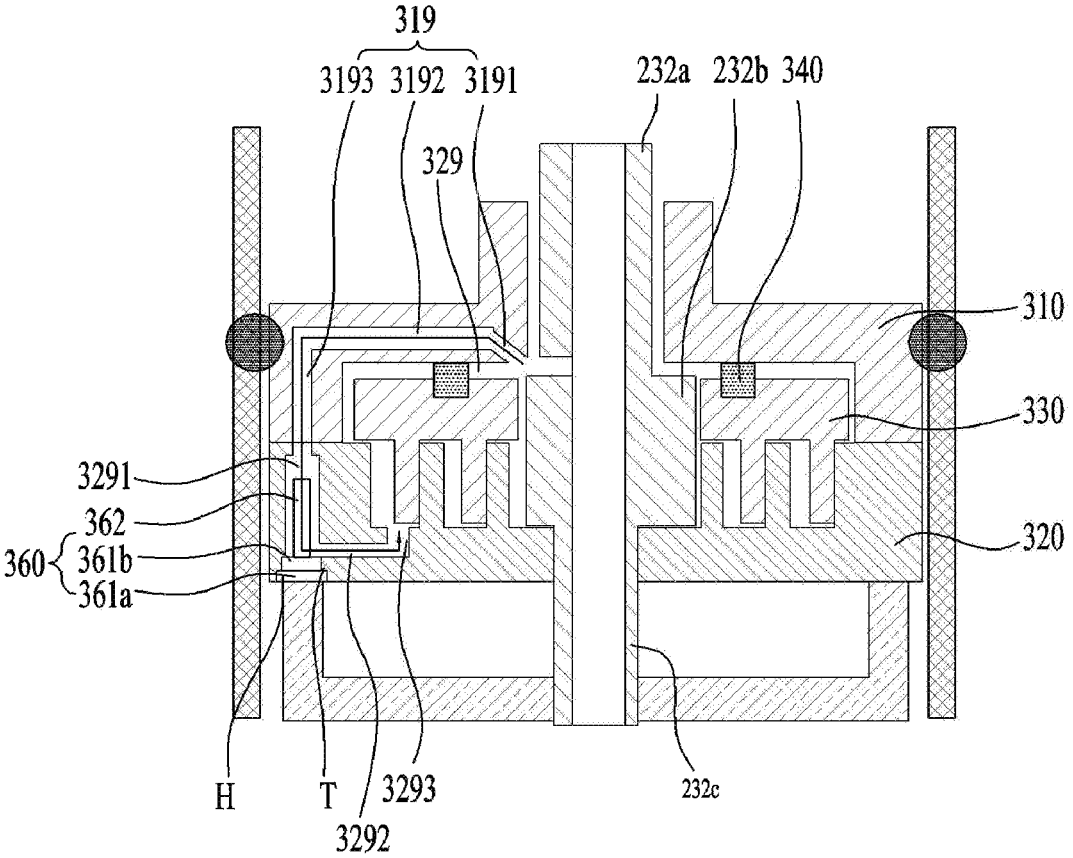
FIG. 5 illustrates a structure of a compressing assembly and a decompressing structure of a scroll type compressor in accordance with another embodiment.

FIG. 5 illustrates another embodiment of the compressor in accordance with the present disclosure. Following descriptions focus on structural differences from the structure of the compressor illustrated in FIG. 3.

Figure 7:
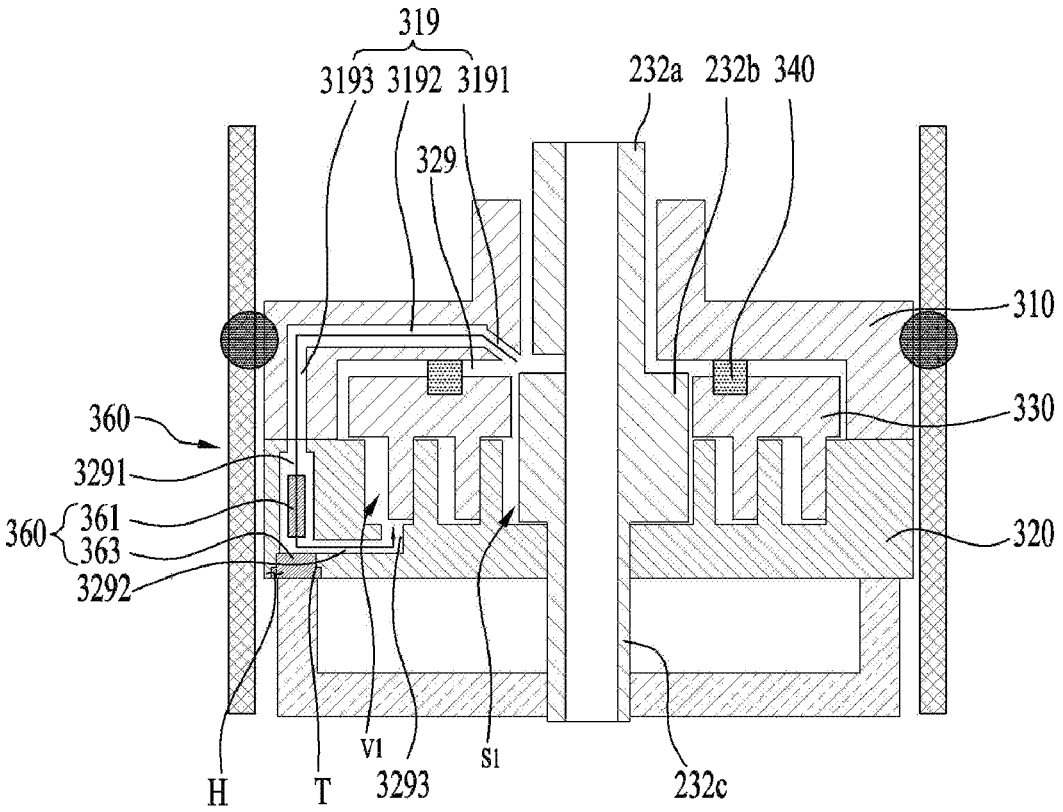
FIG. 7 illustrates a structure of a compressing assembly and a decompressing structure of a scroll type compressor in accordance with another embodiment.

Referring to FIG. 5, the oil transfer channel may be defined in the main frame 310. Referring to FIG. 7, when the oil transfer channel 310 is defined in the main frame, the oil transfer channel 310 may include a main channel 3191 passing through the main shaft receiving portion 318 to receive the oil, and a pass-through channel 3192 extending from the main channel 3191 toward the outer circumferential face along the main end plate 311. The oil may pass through the pass-through channel 3192. The oil transfer channel 310 may include a discharge channel 3193 connected to a distal end of the pass-through channel 3192 and extending toward the fixed frame 320 to discharge the oil.

The main channel 3191 may extend in a parallel manner with a space between the main end plate 311 of the main frame and the orbiting end plate 331 of the orbiting scroll. Thus, the oil discharged from the first oil-feeding hole 241*a* may flow into a space between the main end plate 311 and the orbiting end plate 331 and then may be supplied to the backpressure seal 350, and, at the same time, may be input to the main channel 3191.

The main frame 310 is always fixed to the casing 100. When the oil transfer channel 310 is defined in the main frame 310, this configuration may allow reliable oil supply to the fixed scroll 320. The receiving hole H may be defined to penetrate the main end plate 311 and may communicate with the discharge channel 3193. As such, the decompressing structure 360 may be inserted into the receiving hole H and may be disposed within the discharge channel 3193. The discharge channel 3193 may extend in a parallel manner to a length direction of the rotation shaft 230, so that the decompressing structure 360 may be reliably accommodated therein.

However, since the main frame 310 is directly welded to the casing, local deformation may occur. Further, the main frame 310 acts as a component that supports the rotation shaft 230 and thus is subjected to significant vibration or pressure. Further, the fixed frame 320 may be supported, at the inflow hole 325 thereof, on the casing 100. Thus, the fixed frame 320 may not be welded with the casing 100. Thus, the receiving hole H may be defined in the fixed frame 320 to communicate with inflow channel 3219 of the fixed frame 320.

The fixed channel 329 may be defined to communicate with the oil transfer channel. That is, the inflow channel 3291 may be defined such that one end thereof communicates with the discharge channel 3193. The inflow channel 3291 may include an extension 3291*a* having a larger diameter and may be defined in the same structure as that in the above-described embodiment The decompressing structure 360 may include the decompressing pin 362 inserted into the inflow channel 3291 and a decompressing head 361 disposed on one end of the decompressing pin 362 and coupled to the coupling or receiving hole. The decompressing head 361 may be integrally formed with the decompressing pin 362 or may be combined in a removable manner therewith.

The decompressing head 361 may include a main head 361*a* coupled to the inner circumferential face of the receiving hole H and supported on the stopper T, and an auxiliary head 361*b* extending from the main head to shield the inner circumferential face of the stopper.

At least one of the main head 361*a* and the auxiliary head 361*b* may be embodied as a bolt. At least one of the receiving hole H and the stopper T may have a thread defined in an inner circumferential face thereof corresponding to a thread of the bolt. This allows the main head 361*a* to be coupled to the receiving hole H in a screw-bolt coupling manner, or allows the auxiliary head 361*b* to the stopper T in a screw-bolt coupling manner. Further, the main head 361*a* and the auxiliary head 361*b* may be coupled, in a screw-bolt coupling manner, to the receiving hole H and the stopper T. As a result, the main head 361*a* and the auxiliary head 361*b* of the decompressing structure 360 may perfectly seal the receiving hole H.

The muffler 500 may be coupled to the fixed frame 320 and may support the decompressing structure 360.

Figure 6:
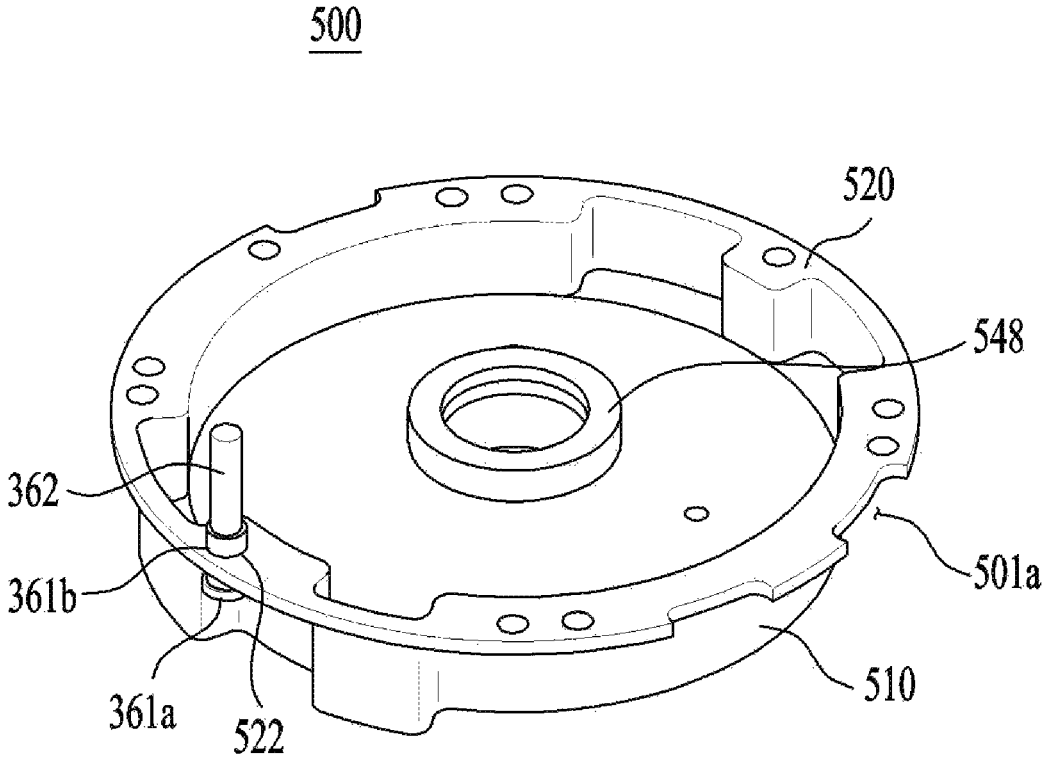
FIG. 6 shows a state in which a decompressing structure is coupled to a muffler.

FIG. 6 illustrates another embodiment of the compressor in accordance with the present disclosure. Following descriptions focus on a structure different from that of the compressor of FIG. 5.

The muffler 500 may include a coupling body 520 having a coupling hole 522 defined to penetrate the coupling body 520 at a portion thereof facing the receiving hole H. The decompressing structure 360 may be inserted into the receiving hole H while passing through the coupling hole 522 and being coupled to the coupling hole 522.

The decompressing structure may be constructed such that the main head 361*a* thereof is coupled to one end of the coupling hole 522 and the auxiliary head 361*b* thereof is coupled to the other end of the coupling hole 522 in an exposed manner. Alternatively, the decompressing structure may be constructed such that a portion of the main head 361*a* and the auxiliary head 361*b* is coupled to the other end of the coupling hole 522 in an exposed manner while the main head 361*a* is coupled to the coupling hole 522.

Further, the main head 361*a* and the auxiliary head 361*b* may be formed separately from each other and then may be combined with each other. Thus, the main head 361*a* and the auxiliary head 361*b* may be respectively coupled at both ends of the coupling hole 522 and may be coupled to the coupling body 520.

Thus, the decompressing structure 360 may be firmly fixed to the muffler 500 and may be received in the inflow channel 3291.

FIG. 7 illustrates another embodiment of the compressor in accordance with the present disclosure. Following descriptions focus on a structure different from those of the compressors described above to avoid duplication of the description.

The decompressing structure 360 may include a decompressing pin 362 inserted into the inflow channel 3291 and a decompressing cover 363 coupled to the receiving hole H to prevent the decompressing pin 362 from being removed from the inflow channel 3291.

The decompressing cover 363 may be formed as a member separately from the decompressing pin 362. The decompressing pin 362 may be housed in the extension 3291*a*. The decompressing cover 363 may seal the receiving hole H.

The fixed scroll may further include a stopper T having a diameter smaller than that of the receiving hole H. The stopper T may be formed in a step manner from the receiving hole H. In this connection, the stopper T may have the same cross sectional area as that of the extension 3291*a*. The receiving hole H may have a larger cross sectional area than that of each of the stopper T and the extension 3291*a*. This makes it easy to form the stopper T on the fixed frame 320.

The decompressing cover 363 may include a main cover 363*a* coupled to the inner circumferential face of the receiving hole and supported on the stopper T. The decompressing cover 363 may further include an auxiliary cover 363*b* extending in a stepwise manner from the main cover 363*a* and coupled to the inner circumferential face of the stopper T.

At least one of the main cover 363*a* or the auxiliary cover 363*b* may be embodied as a bolt. At least one of the receiving hole H or the stopper T may have a thread in the inner circumferential face thereof corresponding to a thread of the bolt. Thus, the main cover 363*a* may be coupled to the receiving hole H in a screw-bolt coupling manner, or the auxiliary cover 363*b* may be coupled to the stopper T in a screw-bolt coupling manner. Further, the main cover 363*a* and the auxiliary cover 363*b* may be coupled, in a screw-bolt combination manner, to the receiving hole H and the stopper T. As a result, the main cover 363*a* and the auxiliary cover 363*b* of the decompressing structure 360 may perfectly seal the receiving hole H.

Figure 8:
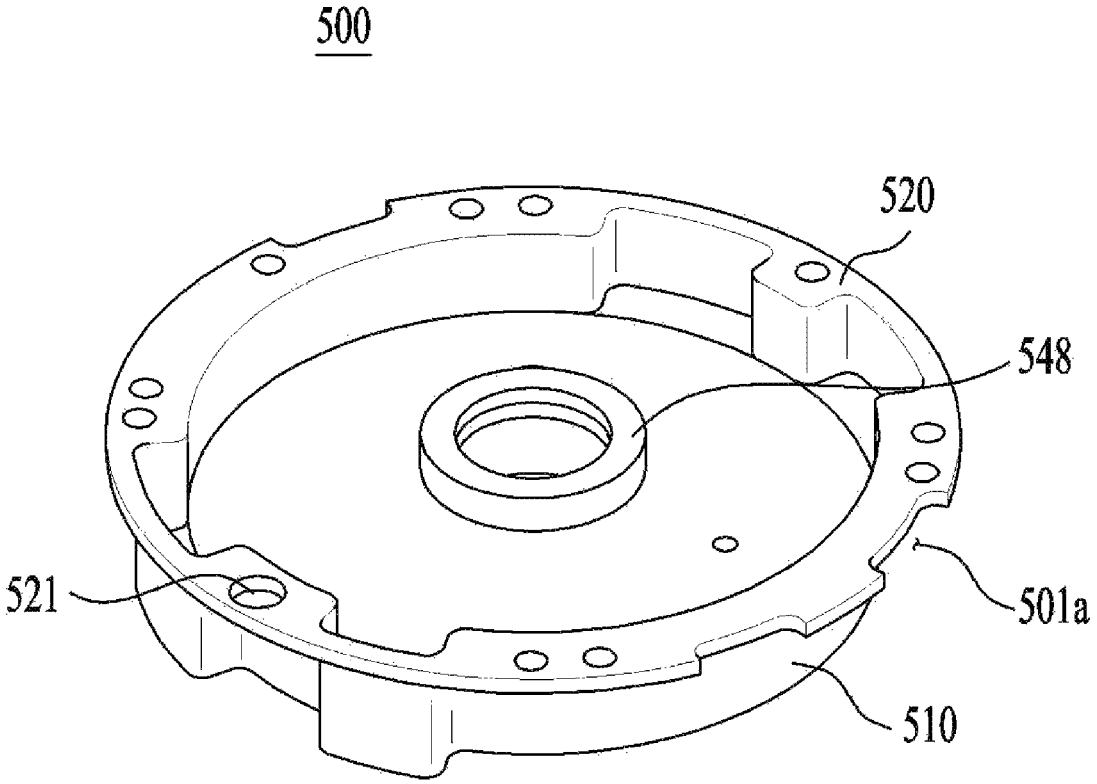
FIG. 8 illustrates another embodiment of a muffler to which a decompressing structure is fixed.

FIG. 8 illustrates another embodiment of the compressor in accordance with the present disclosure. FIG. 8 illustrates a structure of the muffler and may be applied to the embodiments of the compressors as illustrated in FIG. 3 to FIG. 7.

Referring to FIG. 8, the muffler 500 may further include a seat groove 521 defined in the coupling body 520 at a portion thereof corresponding to the receiving hole H. the seat groove 521 may shield or support the decompressing structure 360. The seat groove 521 may be defined to accommodate one end of the decompressing cover 363. Thus, the seat groove 521 may disallow the decompressing cover 363 to be separated from the receiving hole H even when the pressure of the inflow channel 3291 increases. Further, the seat groove 521 may disallow the decompressing structure 360 to contact the refrigerant inside the muffler 500 or the oil stored in the casing. Further, the fixed frame 320 is coupled to the seat groove 521 of the muffler 500 to pressurize the decompressing structure 360 to ensure the stability of the decompressing structure 360.

Further, the seat groove 521 may be defined to receive a portion or an entirety of the decompressing head 362. Thus, the seat groove 521 may disallow the decompressing head 362 to be separated from the receiving hole H even when the pressure of the inflow channel 3291 increases. Further, the seat groove 521 may disallow the decompressing structure 360 to contact the refrigerant inside the muffler 500 or the oil stored in the casing. Further, the fixed frame 320 is coupled to the seat groove 521 of the muffler 500 to pressurize the decompressing structure 360 to ensure the stability of the decompressing structure 360.

As a result, the decompressing structure 360 may not pass through the muffler 500. Rather, the decompressing structure 360 may be pressed in a state in which one end or a free end of the decompressing structure 360 is seated in the seat groove 521.

Figure 9A:
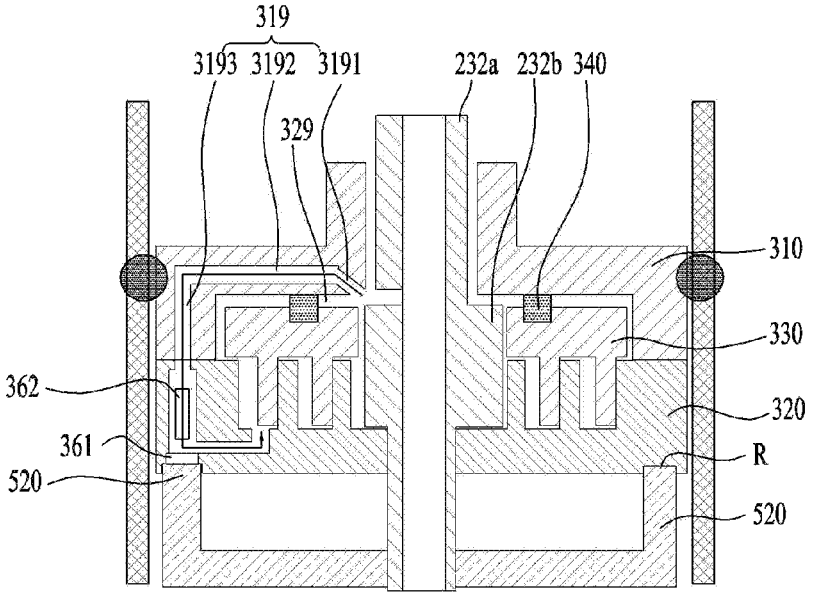
FIGS. 9A and 9B illustrate a structure of a compressing assembly and a decompressing structure of a scroll type compressor in accordance with still another embodiment.
Figure 9B:
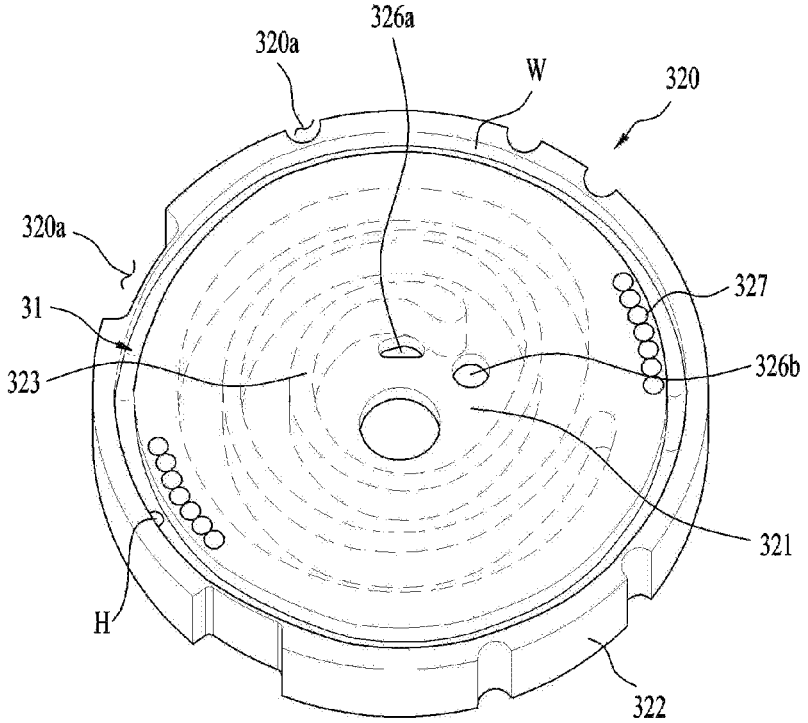

FIGS. 9A and 9B illustrate still another embodiment of the present disclosure compressor.

The compressor illustrated in FIGS. 9A and 9B may be equally applicable to the embodiments of the compressors illustrated in FIG. 3 to FIG. 8, except for a structure of the muffler 500 and the fixed frame 320.

Referring to FIG. 9A, the fixed frame 320 includes a support groove W formed by recessing a portion thereof corresponding to the receiving hole H. The muffler 500 may be inserted into the support groove W and may be coupled to the fixed frame 320. That is, a position of the receiving hole H may coincide with a position of the support groove W.

This allows the muffler 500 to be tightly coupled to the fixed frame 320 due to a wider contact area between the fixed frame 320 and the muffler 500. Further, the sealing effect of the muffler 500 and the fixed frame 320 may be maximized. Further, the muffler 500 seals or supports the decompressing structure 360 and the receiving hole H. This may prevent the refrigerant or oil from contacting or interfering with the decompressing structure 360.

Referring to FIG. 9A, the muffler 500 may include a support ring R that protrudes from and around the coupling body to support the decompressing structure. The support ring R may have a thickness or a height corresponding to that of the support groove W and thus be inserted into the support groove W.

The support ring R may be configured pressurize or support the decompressing structure 360. FIG. 8 illustrates a configuration in which the decompressing structure 360 includes the decompressing pin and the decompressing cover. However, the same principle may be equally applied to a configuration in which the decompressing structure 360 includes the decompressing pin and the decompressing head.

This enhances the coupling between the muffler 500 and the fixed frame 320. Further, the installation stability of the decompressing structure 360 may be maximized.

FIGS. 9A and 9B illustrate an operating aspect of the scroll type compressor 10 of the present disclosure.

Figure 10A:
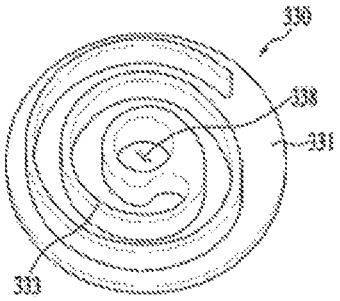
FIGS. 10A to 10C illustrate how a scroll type compressor works in accordance with the present disclosure.
Figure 10B:
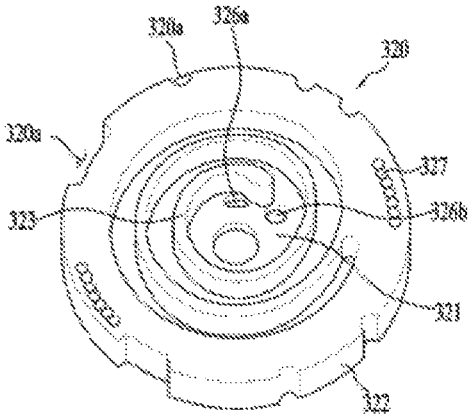
Figure 10C:
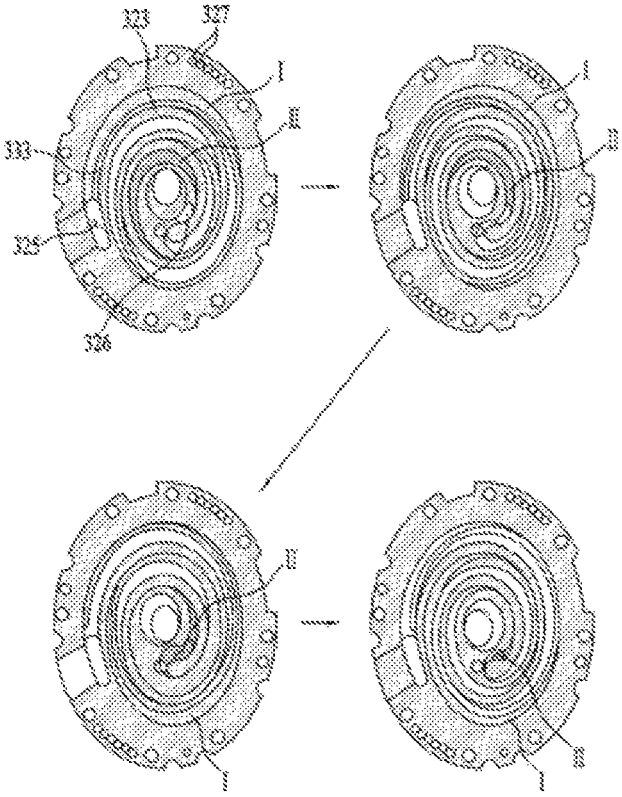

FIG. 10A illustrates the orbiting scroll, FIG. 10B illustrates the fixed scroll, and FIG. 10C illustrates a process in which the orbiting scroll and the fixed scroll compress the refrigerant.

The orbiting scroll 330 may include the orbiting wrap 333 on one face of the orbiting end plate 331, and the fixed scroll 320 may include the fixed wrap 323 on one face of the fixed end plate 321.

In addition, the orbiting scroll 330 is provided as a sealed rigid body to prevent the refrigerant from being discharged to the outside, but the fixed scroll 320 may include the inflow hole 325 in communication with a refrigerant supply pipe such that the refrigerant in a liquid phase of a low temperature and a low pressure may inflow, and the discharge hole 326 through which the refrigerant of a high temperature and a high pressure is discharged. Further, the bypass hole 327 through which the refrigerant discharged from the discharge hole 326 is discharged may be defined in an outer circumferential face of the fixed scroll 320.

In one example, the fixed wrap 323 and the orbiting wrap 333 may be formed in an involute shape and at least two contact points between the fixed wrap 323 and the orbiting wrap 333 may be formed, thereby defining the compression chamber.

The involute shape refers to a curve corresponding to a trajectory of an end of a yarn when unwinding the yarn wound around a base circle having an arbitrary radius as shown.

However, in accordance with the present disclosure, the fixed wrap 323 and the orbiting wrap 333 are formed by combining 20 or more arcs, and radii of curvature of the fixed wrap 323 and the orbiting wrap 333 may vary from part to part.

That is, the compressor accordance with the present disclosure is configured such that the rotation shaft 230 penetrates the fixed scroll 320 and the orbiting scroll 330, and thus the radii of curvature of the fixed wrap 323 and the orbiting wrap 333 and the compression space are reduced.

Thus, in order to compensate for this reduction, in the compressor in accordance with the present disclosure, radii of curvature of the fixed wrap 323 and the orbiting wrap 333 immediately before the discharge may be smaller than that of the penetrated shaft receiving portion of the rotation shaft such that the space to which the refrigerant is discharged may be reduced and a compression ratio may be improved.

That is, the fixed wrap 323 and the orbiting wrap 333 may be more severely bent in the vicinity of the discharge hole 326, and may be more bent toward the inflow hole 325, so that the radii of curvature of the fixed wrap 323 and the orbiting wrap 333 may vary point to point in correspondence with the bent portions.

Referring to FIG. 10C, refrigerant I is flowed into the inflow hole 325 of the fixed scroll 320, and refrigerant II flowed before the refrigerant I is located near the discharge hole 326 of the fixed scroll 320.

In this case, the refrigerant I is present in a region at outer circumferential faces of the fixed wrap 323 and the orbiting wrap 333 where the fixed wrap 323 and the orbiting wrap 333 are engaged with each other, and the refrigerant II is enclosed in another region in which the two contact points between the fixed wrap 323 and the orbiting wrap 333 exist.

Thereafter, when the orbiting scroll 330 starts to orbit, as the region in which the two contact points between the fixed wrap 323 and the orbiting wrap 333 exist is moved based on a position change of the orbiting wrap 333 along an extension direction of the orbiting wrap 333, a volume of the region begins to be reduced, and the refrigerant I starts to flow and be compressed. The refrigerant II starts to be further reduced in volume, be compressed, and guided to the discharge hole 326.

The refrigerant II is discharged from the discharge hole 326, and the refrigerant I flows as the region in which the two contact points between the fixed wrap 323 and the orbiting wrap 333 exist moves in a clockwise direction, and the volume of the refrigerant I decreases and starts to be compressed more.

As the region in which the two contact points between the fixed wrap 323 and the orbiting wrap 333 exist moves again in the clockwise direction to be closer to an interior of the fixed scroll, the volume of the refrigerant I further decreases and the refrigerant II is almost discharged.

As such, as the orbiting scroll 330 orbits, the refrigerant may be compressed linearly or continuously while flowing into the fixed scroll.

Although the drawing shows that the refrigerant flows into the inflow hole 325 discontinuously, this is for illustrative purposes only, and the refrigerant may be supplied continuously. Further, the refrigerant may be accommodated and compressed in each region where the two contact points between the fixed wrap 323 and the orbiting wrap 333 exist.

Effects as not described herein may be derived from the above configurations. The relationship between the above-described components may allow a new effect not seen in the conventional approach to be derived.

In addition, embodiments shown in the drawings may be modified and implemented in other forms. The modifications should be regarded as falling within a scope of the present disclosure when the modifications is carried out so as to include a component claimed in the claims or within a scope of an equivalent thereto.

What is claimed is:

1. A compressor comprising:

a casing that defines a reservoir space configured to store oil, the casing comprising a discharger disposed at a side of the casing and configured to discharge refrigerant;

a driver coupled to an inner circumferential surface of the casing;

a rotation shaft rotatably coupled to the driver and configured to supply the oil; and a compressing assembly that is coupled to the rotation shaft, that is configured to be lubricated with the oil, and that is configured to compress the refrigerant, wherein the compressing assembly comprises:

an orbiting scroll coupled to the rotation shaft, a fixed scroll that is engaged with the orbiting scroll and that is configured to receive the refrigerant and to compress and discharge the refrigerant, wherein the orbiting scroll is configured to orbit relative to the fixed scroll based on rotation of the rotation shaft, a main frame that is mounted on the fixed scroll and that accommodates the orbiting scroll, wherein the rotation shaft passes through the main frame, an oil transfer channel defined in at least one of the orbiting scroll or the main frame and configured to transfer the oil supplied from the rotation shaft, a fixed channel that is defined in the fixed scroll, that is in communication with the oil transfer channel, and that is configured to supply the oil from the oil transfer channel into a space between the orbiting scroll and the fixed scroll, and a decompressing structure that is disposed in the oil transfer channel or the fixed channel, and that is configured to regulate an amount of oil supplied to the space between the orbiting scroll and the fixed scroll, wherein the decompressing structure is disposed toward the discharger, wherein the fixed scroll further defines a receiving hole that extends through one surface of the fixed scroll and is in fluid communication with the fixed channel, and wherein the compressor further comprises a muffler that is coupled to the fixed scroll, that seals the receiving hole, and that is configured to guide the refrigerant discharged from the compressing assembly to the discharger.

2. The compressor of claim 1, wherein the decompressing structure is inserted into the oil transfer channel or the fixed channel and disposed in parallel to the rotation shaft.

3. The compressor of claim 1, wherein the fixed scroll comprises:

a fixed end plate coupled to the rotation shaft;

a fixed side plate that extends along an outer circumferential surface of the fixed end plate and that supports the main frame; and a fixed wrap that protrudes from the fixed end plate and that is engaged with the orbiting scroll, wherein the fixed channel comprises:

an inflow channel that is defined in the fixed side plate, that is in communication with the oil transfer channel, and that is configured to receive the oil supplied from the oil transfer channel, and a fixed wrap communication channel that is defined in the fixed end plate, that is in communication with the inflow channel, and that is configured to guide the oil from the inflow channel to the fixed wrap, and wherein the decompressing structure is received in the inflow channel.

4. The compressor of claim 3, wherein the inflow channel comprises an extension that extends from an end portion of the inflow channel and that receives the decompressing structure, and wherein a diameter of the extension is greater than a diameter of the end portion of the inflow channel.

5. The compressor of claim 1, wherein the decompressing structure is inserted into the receiving hole.

6. The compressor of claim 5, wherein the decompressing structure comprises:

a decompressing pin inserted into the fixed channel; and a decompressing head disposed on one end of the decompressing pin, and wherein a diameter of the decompressing head is greater than a diameter of the decompressing pin.

7. The compressor of claim 5, wherein the decompressing structure comprises:

a decompressing pin inserted into the fixed channel; and a decompressing cover coupled to the receiving hole and configured to restrict escape of the decompressing pin from the fixed channel.

8. The compressor of claim 5, wherein the muffler comprises:

a receiving body that defines a refrigerant flow space therein;

a coupling body that extends from an outer circumferential surface of the receiving body and that is coupled to the fixed scroll; and a support ring that protrudes from and extends around the coupling body and that supports the decompressing structure, and wherein the fixed scroll further defines a support groove that receives the support ring and that is disposed at a position corresponding to the receiving hole.

9. A compressor comprising:

a casing that defines a reservoir space configured to store oil, the casing comprising a discharger disposed at a side of the casing and configured to discharge a refrigerant;

a driver coupled to an inner circumferential surface of the casing;

a rotation shaft rotatably coupled to the driver and configured to supply the oil; and a compressing assembly that is coupled to the rotation shaft, that is configured to be lubricated with the oil, and that is configured to compress the refrigerant, wherein the compressing assembly comprises:

an orbiting scroll coupled to the rotation shaft and configured to orbit based on rotation of the rotation shaft, a fixed scroll that is engaged with the orbiting scroll and that is configured to receive the refrigerant and to compress and discharge the refrigerant, the fixed scroll defining a fixed channel therein configured to supply the oil supplied from the rotation shaft to the orbiting scroll, a main frame that is mounted on the fixed scroll and that accommodates the orbiting scroll, wherein the rotation shaft passes through the main frame, and a decompressing structure disposed in the fixed channel and configured to control an amount of oil supplied to the orbiting scroll, wherein the fixed scroll further defines a receiving hole that extends through one surface of the fixed scroll and is in fluid communication with the fixed channel, and wherein the compressor further comprises a muffler that is coupled to the fixed scroll, that seals the receiving hole, and that is configured to guide the refrigerant discharged from the compressing assembly to the discharger.

10. The compressor of claim 9, wherein the decompressing structure is inserted into the receiving hole.

11. The compressor of claim 10, wherein the decompressing structure comprises:

a decompressing pin inserted into the fixed channel; and a decompressing head disposed on one end of the decompressing pin, and wherein a diameter of the decompressing head is greater than a diameter of the decompressing pin.

12. The compressor of claim 11, wherein the fixed scroll comprises a stopper that protrudes from an inner circumferential surface of the fixed channel and that is supported by the decompressing head, and wherein a recess depth of the receiving hole from the one surface of the fixed scroll corresponds to a thickness of the decompressing head.

13. The compressor of claim 11, wherein the fixed scroll comprises a stopper that defines a recess that extends from the receiving hole, the recess having a diameter less than a diameter of the receiving hole, and wherein the decompressing head comprises:

a main head that is coupled to an inner circumferential surface of the receiving hole and that supports the stopper; and an auxiliary head that extends from the main head, that is received in the recess, and that covers an inner circumferential surface of the stopper.

14. The compressor of claim 11, wherein the muffler comprises:

a receiving body that defines a refrigerant flow space therein; and a coupling body that extends from an outer circumferential surface of the receiving body, that is coupled to the fixed scroll, that is in contact with the decompressing head.

15. The compressor of claim 11, wherein the muffler comprises:

a receiving body that defines a refrigerant flow space therein; and a coupling body that extends from an outer circumferential surface of the receiving body, that is coupled to the fixed scroll, and that defines a coupling hole coupled to the decompressing head.

16. The compressor of claim 10, wherein the decompressing structure comprises:

a decompressing pin inserted into the fixed channel; and a decompressing cover that is coupled to the receiving hole and that is configured to restrict escape of the decompressing pin from the fixed channel.

17. The compressor of claim 16, wherein the fixed scroll further comprises a stopper that defines a recess that extends from the receiving hole, the recess having a diameter less than a diameter of the receiving hole, and wherein the decompressing cover comprises a main cover that is coupled to an inner circumferential surface of the receiving hole and that supports the stopper.

18. The compressor of claim 17, wherein the decompressing cover further comprises an auxiliary cover that extends from the main cover and that covers an inner circumferential surface of the stopper.

19. The compressor of claim 16, wherein the muffler comprises:

a receiving body that defines a refrigerant flow space therein; and a coupling body that extends from an outer circumferential surface of the receiving body, that is coupled to the fixed scroll, and that defines a seat groove that seats the decompressing cover.

20. The compressor of claim 19, wherein the seat groove receives at least a portion of the decompressing cover.

21. The compressor of claim 10, wherein the muffler comprises:

a receiving body that defines a refrigerant flow space therein;

a coupling body that extends from an outer circumferential surface of the receiving body and that is coupled to the fixed scroll; and a support ring that protrudes from and extends around the coupling body and that supports the decompressing structure, and wherein the fixed scroll further defines a support groove that receives the support ring and that is disposed at a position corresponding to the receiving hole.

* * * * *